US012704269B2

(12) United States Patent
Morioka et al.

(10) Patent No.: US 12,704,269 B2
(45) Date of Patent: Aug. 11, 2026

(54) AIR CONDITIONER AND DISCHARGE UNIT

(71) Applicant: Mitsubishi Electric Corporation, Tokyo (JP)

(72) Inventors: Reiji Morioka, Tokyo (JP); Mitsuhiro Shirota, Tokyo (JP); Hirotaka Ishida, Tokyo (JP); Shinji Kawai, Tokyo (JP); Hisanori Ikeda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 163 days.

(21) Appl. No.: 18/262,666

(22) PCT Filed: Apr. 20, 2021

(86) PCT No.: PCT/JP2021/016024
§ 371 (c)(1),
(2) Date: Jul. 24, 2023

(87) PCT Pub. No.: WO2022/224346
PCT Pub. Date: Oct. 27, 2022

(65) Prior Publication Data
US 2024/0077213 A1 Mar. 7, 2024

(51) Int. Cl.
*F24F 1/0011* (2019.01)
*F24F 1/0076* (2019.01)

(52) U.S. Cl.
CPC ..... *F24F 1/0011* (2013.01); *F24F 1/0076* (2019.02)

(58) Field of Classification Search
CPC ..... F24F 1/0011; F24F 1/0057; F24F 1/0076; F24F 13/28; F24F 2221/17
See application file for complete search history.

(56) References Cited

U.S. PATENT DOCUMENTS

2005/0284168 A1* 12/2005 Lee ..... F24F 1/0073 55/471

FOREIGN PATENT DOCUMENTS

| | | | |
|---|---|---|---|
| CN | 202581565 | U | 12/2012 |
| CN | 103341408 | A | 10/2013 |
| CN | 103623924 | A | 3/2014 |
| CN | 103968530 | A | 8/2014 |

(Continued)

OTHER PUBLICATIONS

International Search Report of the International Search Authority mailed May 25, 2021 in corresponding International Application No. PCT/JP2021/016024 (and English translation).

(Continued)

*Primary Examiner* — Steven B McAllister
*Assistant Examiner* — Michael James Giordano
(74) *Attorney, Agent, or Firm* — Posz Law Group, PLC

(57) ABSTRACT

An air conditioner includes a wall-mounted indoor unit which includes a heat exchanger, a blower, and a housing that accommodates the heat exchanger and the blower therein, and which is fixed to a wall surface, and a discharge unit which is disposed above the indoor unit outside the indoor unit. The indoor unit includes a first control unit that controls the indoor unit. The housing includes a suction port that opens upward. The discharge unit includes a discharge device disposed above the suction port, and at least a portion of air suctioned into the suction port passes through the discharge device. The discharge device is driven based on a signal received from the first control unit.

18 Claims, 14 Drawing Sheets

(56) References Cited

FOREIGN PATENT DOCUMENTS

| | | | | |
|---|---|---|---|---|
| CN | 104390319 | A | 3/2015 | |
| CN | 107781920 | A | 3/2018 | |
| CN | 207763075 | U | 8/2018 | |
| CN | 212362278 | U | 1/2021 | |
| EP | 2700452 | A2 | 2/2014 | |
| JP | S59-145624 | U | 9/1984 | |
| JP | S60-128230 | U | 8/1985 | |
| JP | S62-160224 | U | 10/1987 | |
| JP | 2011-106740 | A | 6/2011 | |
| JP | 2011-106741 | A | 6/2011 | |
| JP | 2015-131153 | A | 7/2015 | |
| JP | 2020-085404 | A | 6/2020 | |
| KR | 0111167 | Y1 * | 4/1998 | ..... F24F 1/0057 |
| WO | 2019/114951 | A1 | 6/2019 | |

OTHER PUBLICATIONS

Office Action mailed Feb. 6, 2024 in corresponding Japanese Patent Application No. 2023-515925 (and English machine translation).
Office Action dated Dec. 17, 2024 issued for the corresponding German Patent Application No. 112021007537.3 (and English translation).
Office Action mailed Dec. 25, 2025 in corresponding Chinese patent application No. 202180095992.9 (and English machine translation).
Office Action mailed on May 21, 2026 for the corresponding Chinese patent application No. 202180095992.9 (and an English machine translation).

* cited by examiner

AIR CONDITIONER AND DISCHARGE UNIT

CROSS REFERENCE TO RELATED APPLICATION

This application is a U.S. national stage application of International Application No. PCT/JP2021/016024, filed on Apr. 20, 2021, the contents of which are incorporated herein by reference.

TECHNICAL FIELD

The present disclosure relates to an air conditioner and a discharge unit.

BACKGROUND

An air conditioner including a discharge device inside an indoor unit is known. For example, in Patent Document 1, an air conditioner including an electric dust collector is described as a discharge device.

PATENT DOCUMENT

Patent Document 1

Japanese Unexamined Patent Application, First Publication No. 2015-131153

On the other hand, air conditioners that are not equipped with a discharge device are also known. There is a demand for incorporating a discharge device into such an air conditioner afterward. However, in a case where a discharge device is incorporated afterward, there is a problem of the large workload and amount of time required for incorporating the discharge device, such as that due to the need to replace a control substrate provided inside an indoor unit.

SUMMARY

The present disclosure has been made to solve the above-described problem, and one of the objects thereof is to provide an air conditioner having a structure in which a discharge device can be easily attached to an indoor unit, and a discharge unit that is easily attached to the indoor unit.

An air conditioner according to an aspect of the present disclosure is an air conditioner including a wall-mounted indoor unit which includes a heat exchanger, a blower, and a housing that accommodates the heat exchanger and the blower therein, and which is fixed to a wall surface, and a discharge unit which is disposed above the indoor unit outside the indoor unit, in which the indoor unit includes a first control unit that controls the indoor unit, the housing includes a suction port that opens upward, the discharge unit includes a discharge device disposed above the suction port, at least a portion of air suctioned into the suction port passes through the discharge device, and the discharge device is driven based on a signal received from the first control unit.

A discharge unit according to an aspect of the present disclosure is a discharge unit, in which a discharge unit is disposed above a wall-mounted indoor unit outside the indoor unit fixed to a wall surface, the discharge unit includes a discharge device that is disposed above a suction port provided in the indoor unit, at least a portion of air suctioned into the suction port passes through the discharge device, and the discharge device is driven based on a signal received from a control unit of the indoor unit.

According to the present disclosure, a discharge device can be easily attached to an indoor unit.

DETAILED DESCRIPTION

Figure 1:
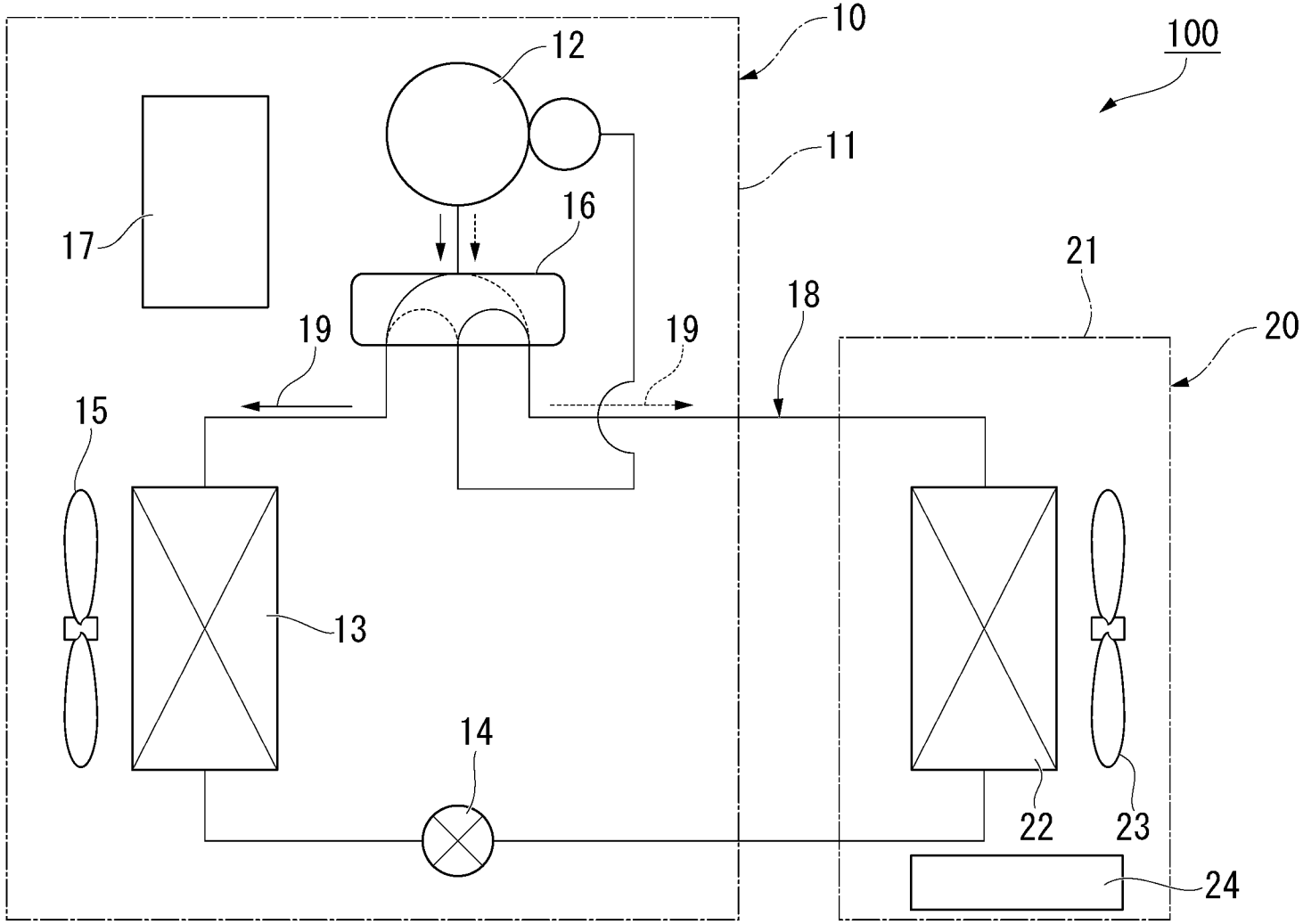
FIG. 1 is a schematic diagram showing a schematic configuration of an air conditioner according to an embodiment.

Hereinafter, an embodiment of the present disclosure will be described with reference to the drawings. Note that the scope of the present disclosure is not limited to the following embodiment and can be arbitrarily changed within the scope of the technical idea of the present disclosure. Further, in the following drawings, the scale, number, and the like of each structure may differ from the scale, number, and the like of the actual structure in order to facilitate the understanding of each configuration.

In the drawings, an X-axis, a Y-axis, and a Z-axis are indicated as appropriate. The X-axis indicates a front-rear direction of an indoor unit 20 in an air conditioner 100 of the following embodiment. The Y-axis indicates a right-left direction of the indoor unit 20. The Z-axis indicates a vertical direction. The front-rear direction, the right-left direction, and the vertical direction are directions perpendicular to each other. A side (+X side) that an X-axis arrow faces in the front-rear direction is a front side, and a side (−X side) opposite to the side that the X-axis arrow faces in the front-rear direction is a rear side. A side (+Y side) that a Y-axis arrow faces in the right-left direction is a left side, and a side opposite to the side that the Y-axis arrow faces in the right-left direction is a right side. A side (+Z side) that a Z-axis arrow faces in the vertical direction is an upper side, and a side (−Z side) opposite to the side that the Z-axis arrow faces in the vertical direction is a lower side. Note that the left side in the following embodiment is equivalent to "one side in the right-left direction".

FIG. 1 is a schematic diagram showing a schematic configuration of an air conditioner 100 according to an embodiment. As shown in FIG. 1, the air conditioner 100 includes an outdoor unit 10, an indoor unit 20, and a circulation path portion 18. The outdoor unit 10 is disposed outdoors. The indoor unit 20 is disposed indoors. The outdoor unit 10 and the indoor unit 20 are connected to each other by the circulation path portion 18 through which a refrigerant 19 circulates.

The air conditioner 100 can adjust the temperature of the indoor air by exchanging heat between the refrigerant 19 flowing through the circulation path portion 18 and air in the room in which the indoor unit 20 is disposed. Examples of the refrigerant 19 include a fluorine-based refrigerant having a low global warming potential (GWP), a hydrocarbon-based refrigerant, and the like.

The outdoor unit 10 includes an outdoor unit housing 11, a compressor 12, a heat exchanger 13, a flow control valve 14, a blower 15, a four-way valve 16, and a control unit 17. The compressor 12, the heat exchanger 13, the flow control valve 14, the blower 15, the four-way valve 16, and the control unit 17 are accommodated in the outdoor unit housing 11.

The compressor 12, the heat exchanger 13, the flow control valve 14, and the four-way valve 16 are provided in a portion of the circulation path portion 18 which is positioned inside the outdoor unit housing 11. The compressor 12, the heat exchanger 13, the flow control valve 14, and the four-way valve 16 are connected to each other by a portion of the circulation path portion 18 which is positioned inside the outdoor unit housing 11.

The four-way valve 16 is provided in a portion of the circulation path portion 18 which is connected to a discharge side of the compressor 12. The four-way valve 16 can reverse the direction of the refrigerant 19 flowing through the circulation path portion 18 by switching a path of a portion of the circulation path portion 18. When a path connected by the four-way valve 16 is a path indicated by a solid line in the four-way valve 16 in FIG. 1, the refrigerant 19 flows through the circulation path portion 18 in a direction indicated by a solid arrow in FIG. 1. On the other hand, when the path connected by the four-way valve 16 is a path indicated by a dashed line in the four-way valve 16 in FIG. 1, the refrigerant 19 flows through the circulation path portion 18 in a direction indicated by the dashed arrow in FIG. 1.

Figure 2:
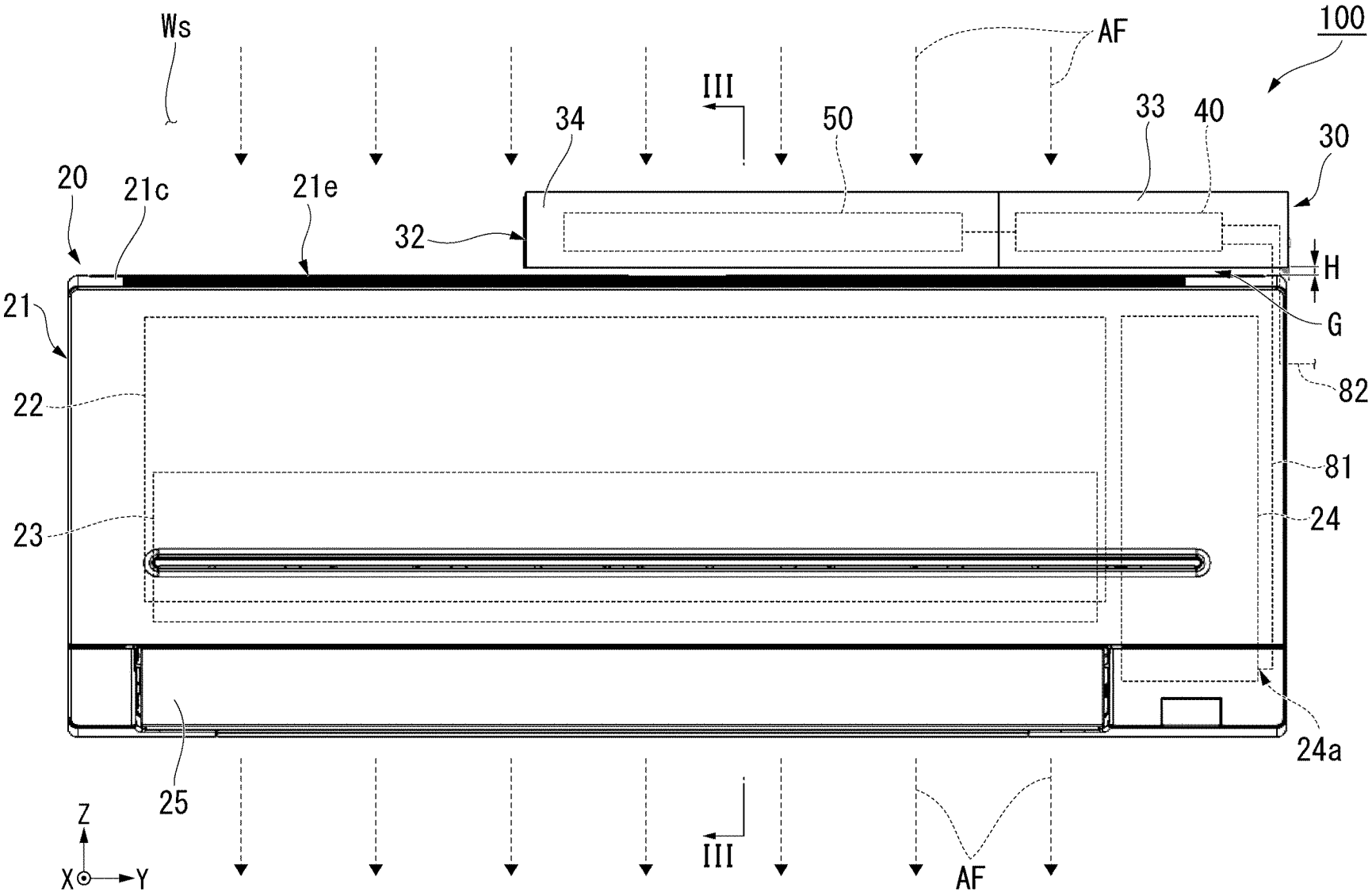
FIG. 2 is a front view of an indoor unit and a discharge unit according to the embodiment.
Figure 3:
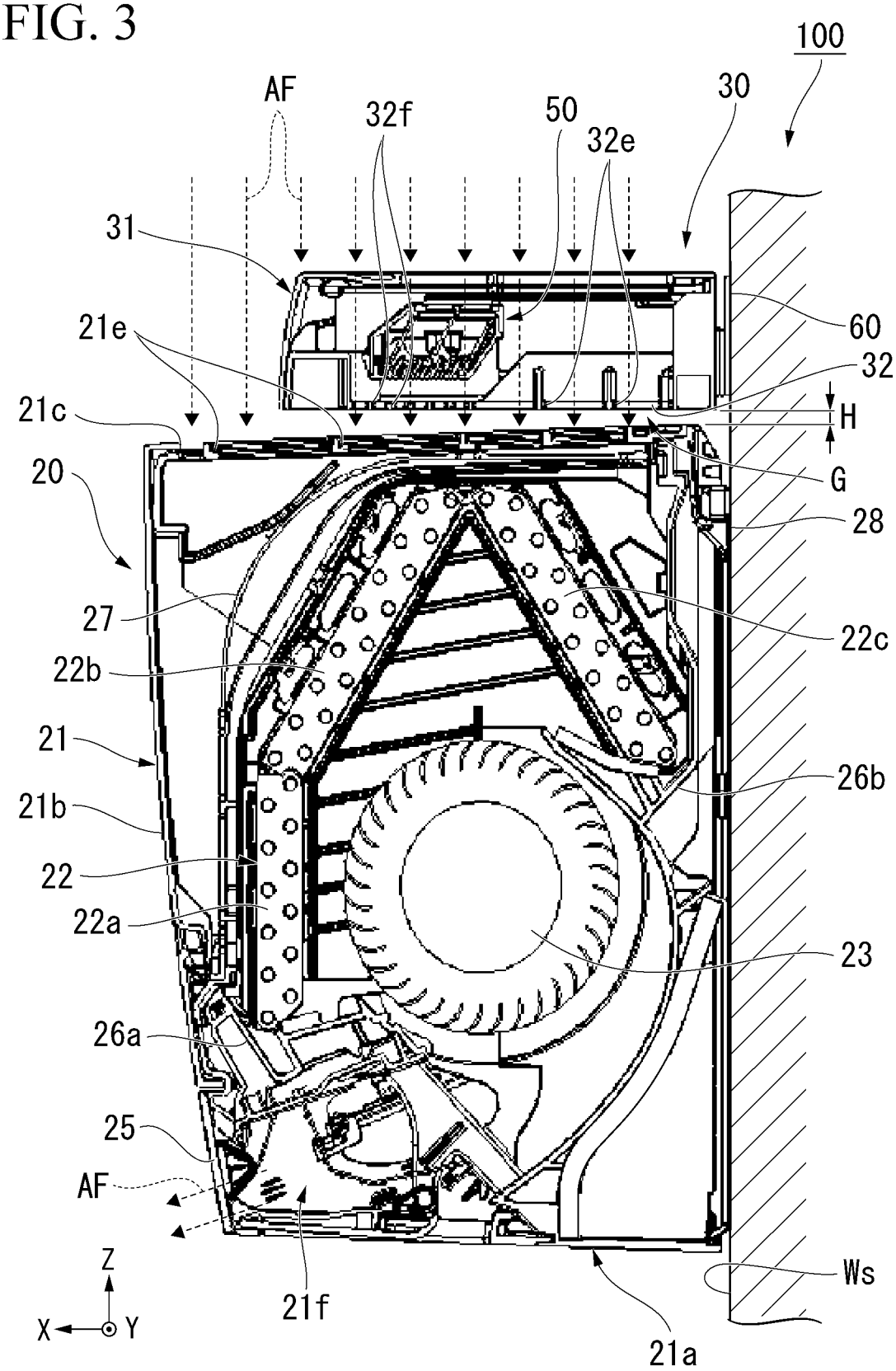
FIG. 3 is a cross-sectional view showing the indoor unit and the discharge unit in the embodiment and taken along line III-III in FIG. 2.
Figure 4:
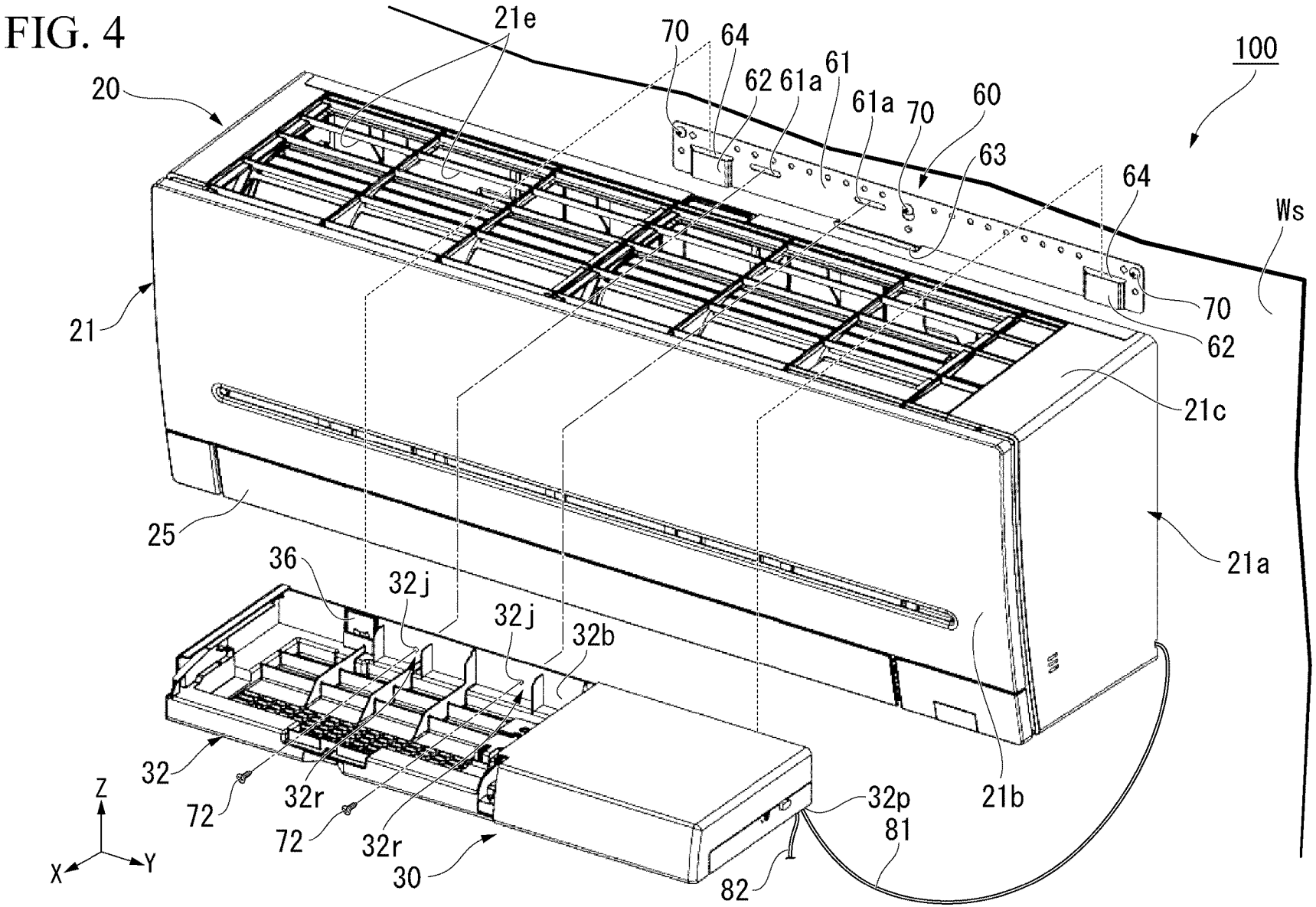
FIG. 4 is an exploded perspective view showing portions of the indoor unit and the discharge unit in the embodiment.

FIG. 2 is a front view of the indoor unit 20 and a discharge unit 30 which will be described later. FIG. 3 is a cross-sectional view showing the indoor unit 20 and the discharge unit 30 and taken along line III-III in FIG. 2. FIG. 4 is an exploded perspective view showing portions of the indoor unit 20 and the discharge unit 30.

As shown in FIGS. 2 to 4, the indoor unit 20 is a wall-mounted indoor unit that is fixed to an indoor wall surface Ws. The wall surface Ws faces forward (+X direction). The indoor unit 20 has a substantially rectangular parallelepiped shape elongated in the right-left direction. As shown in FIG. 2, the indoor unit 20 includes an indoor unit housing (housing) 21, a heat exchanger 22, a blower 23, and a first control unit 24. In addition, as shown in FIG. 3, the indoor unit 20 includes a wind direction varying vane 25, drain pans 26*a* and 26*b*, and an air conditioner filter 27.

The indoor unit housing 21 is a housing that accommodates the heat exchanger 22, the blower 23, the first control unit 24, the drain pans 26*a* and 26*b*, and the air conditioner filter 27 therein. The indoor unit housing 21 has a box-shaped main body portion 21*a* that opens forward (+X direction), and a front panel 21*b* attached to the front of the main body portion 21*a*. The front panel 21*b* is attached to the front of the main body portion 21*a* so as to be openable and closable. When the front panel 21*b* is opened, the first control unit 24 and the air conditioner filter 27 are exposed to the outside of the indoor unit 20.

The indoor unit housing 21 includes a suction port 21*e* that opens upward and a blow-out port 21*f* that opens downward. The suction port 21*e* is formed in a top wall portion 21*c* positioned on the upper side of the main body portion 21*a*. The upper surface of the top wall portion 21*c* is an upper surface of the indoor unit 20. In the present embodiment, the upper surface of the top wall portion 21*c* is an inclined surface positioned downward toward the front. As shown in FIG. 4, a plurality of suction ports 21*e* are disposed in a matrix along the front-rear direction and the right-left direction. Thereby, a portion of the top wall portion 21*c* where the plurality of suction ports 21*e* are provided has a lattice shape.

As shown in FIG. 3, the blow-out port 21*f* is provided in a front (+X direction) portion at a lower end portion of the main body portion 21*a*. The wind direction varying vane 25 is rotatably attached to the blow-out port 21*f*. The wind direction varying vane 25 can change the direction of air blown out from the blow-out port 21*f* in the vertical direction. Although not shown in the drawing, a wind direction varying vane capable of changing the direction of air blown out from the blow-out port 21*f* to the right-left direction is also provided at the back of the blow-out port 21*f*.

The blower 23 suctions indoor air AF from the suction port 21*e* and blows the suctioned air AF from the blow-out port 21*f*. In the present embodiment, the blower 23 is a cross-flow fan. As shown in FIG. 2, the blower 23 extends in the right-left direction. Note that the blower 23 may be any type of blower.

The heat exchanger 22 is provided in the circulation path portion 18 and performs heat exchange between the refrigerant 19 flowing through the circulation path portion 18 and the indoor air AF suctioned into the indoor unit housing 21. The heat exchanger 22 is disposed in an air passage formed by the blower 23. As shown in FIG. 3, the heat exchanger 22 in the present embodiment includes a first heat exchanger 22*a*, a second heat exchanger 22*b*, and a third heat exchanger 22*c*.

The first heat exchanger 22*a* is positioned in front (+X direction) of the blower 23. The second heat exchanger 22*b* is connected above the first heat exchanger 22*a*. When viewed in the right-left direction, the second heat exchanger 22*b* extends upward and obliquely rearward (−X direction) from the upper end portion of the first heat exchanger 22*a*. The third heat exchanger 22*c* is positioned behind the second heat exchanger 22*b*. When viewed in the right-left direction, the third heat exchanger 22*c* extends downward and obliquely rearward from the upper end portion of the second heat exchanger 22*b*. The second heat exchanger 22*b* and the third heat exchanger 22*c* are positioned above the blower 23. The first heat exchanger 22*a*, the second heat exchanger 22*b*, and the third heat exchanger 22*c* are disposed to surround the blower 23 in an air passage from the suction port 21*e* to the blow-out port 21*f*.

The air AF suctioned into the indoor unit housing 21 from the suction port 21*e* by the blower 23 passes through the heat exchanger 22 and exchanges heat with the refrigerant 19 at that time. After the heat exchange, the air AF is blown out of the indoor unit 20 from the blow-out port 21*f*. Thereby, the air AF heat-exchanged with the refrigerant 19 by the heat exchanger 22 is blown into the room from the blow-out port 21*f*.

Note that the heat exchanger 22 may have any structure as long as heat can be exchanged between the refrigerant 19 and the indoor air AF. For example, the heat exchanger 22 may be constituted by only the first heat exchanger 22*a* and the second heat exchanger 22*b* without including the third heat exchanger 22*c*.

The drain pan 26*a* is disposed below the first heat exchanger 22*a*. The drain pan 26*b* is disposed below the third heat exchanger 22*c*. The drain pans 26*a* and 26*b* are members for collecting dew condensation water.

The air conditioner filter 27 is disposed to cover the entire suction port 21*e* between the suction port 21*e*, the second heat exchanger 22*b*, and the third heat exchanger 22*c*. The air AF suctioned into the indoor unit housing 21 through the suction port 21*e* passes through the air conditioner filter 27 and then passes through the heat exchanger 22. The air conditioner filter 27 is a pre-filter capable of catching relatively large dust such as fibers mixed in the air AF. By providing the air conditioner filter 27, it is possible to prevent relatively large dust such as fibers mixed in the air AF from being caught between fins of the heat exchanger 22. Although not shown in the drawing, two air conditioner filters 27 are arranged side by side in the right-left direction in the present embodiment. Note that the fibers mixed in the air AF include, for example, relatively long fibers coming out of bedclothes.

The first control unit 24 is a control unit that controls the indoor unit 20. The first control unit 24 controls, for example, the blower 23, the wind direction varying vane 25, and the like. As shown in FIG. 2, the first control unit 24 is positioned inside the indoor unit housing 21 on the left side (+Y side) of the heat exchanger 22 and the blower 23. A connection portion 24*a* to which a signal wiring 81, which will be described later, is connected is provided in a left portion of the first control unit 24. Although not shown in the drawing, the first control unit 24 includes a control substrate.

In the present embodiment, the indoor unit 20 is capable of a cooling operation for cooling air in the room in which the indoor unit 20 is disposed and a heating operation for warming air in the room in which the indoor unit 20 is disposed.

When the indoor unit 20 is in a cooling operation mode, the refrigerant 19 flowing through the circulation path portion 18 flows in a direction indicated by the solid arrow in FIG. 1. That is, when the indoor unit 20 is in a cooling operation mode, the refrigerant 19 flowing through the circulation path portion 18 circulates to pass through the compressor 12, the heat exchanger 13 of the outdoor unit 10, the flow control valve 14, and the heat exchanger 22 of the indoor unit 20 in this order and return to the compressor 12. In the cooling operation, the heat exchanger 13 inside the outdoor unit 10 functions as a condenser, and the heat exchanger 22 inside the indoor unit 20 functions as an evaporator.

On the other hand, when the indoor unit 20 is in a heating operation mode, the refrigerant 19 flowing through the circulation path portion 18 flows in a direction indicated by the dashed line in FIG. 1. That is, when the indoor unit 20 is in a heating operation mode, the refrigerant 19 flowing through the circulation path portion 18 circulates to pass through the compressor 12, the heat exchanger 22 of the indoor unit 20, the flow control valve 14, and the heat exchanger 13 of the outdoor unit 10 in this order and return to the compressor 12. In the heating operation, the heat exchanger 13 inside the outdoor unit 10 functions as an evaporator, and the heat exchanger 22 inside the indoor unit 20 functions as a condenser.

As shown in FIGS. 2 to 4, the air conditioner 100 includes a discharge unit 30 disposed outside the indoor unit 20 and above the indoor unit 20. In the present embodiment, the discharge unit 30 is a device having a function of cleaning the indoor air AF. The discharge unit 30 is disposed above the indoor unit 20 with a predetermined gap G therebetween. A dimension H of the gap Gin the vertical direction is, for example, 5 mm or more and 50 mm or less. The dimension H of the gap G in the vertical direction is, for example, preferably 5 mm. In the present embodiment, the gap G increases in the vertical direction toward the front. The dimension H is a dimension in the vertical direction at a rear-side (−X side) end portion of the gap G, and is the minimum dimension of the gap G in the vertical direction.

Figure 5:
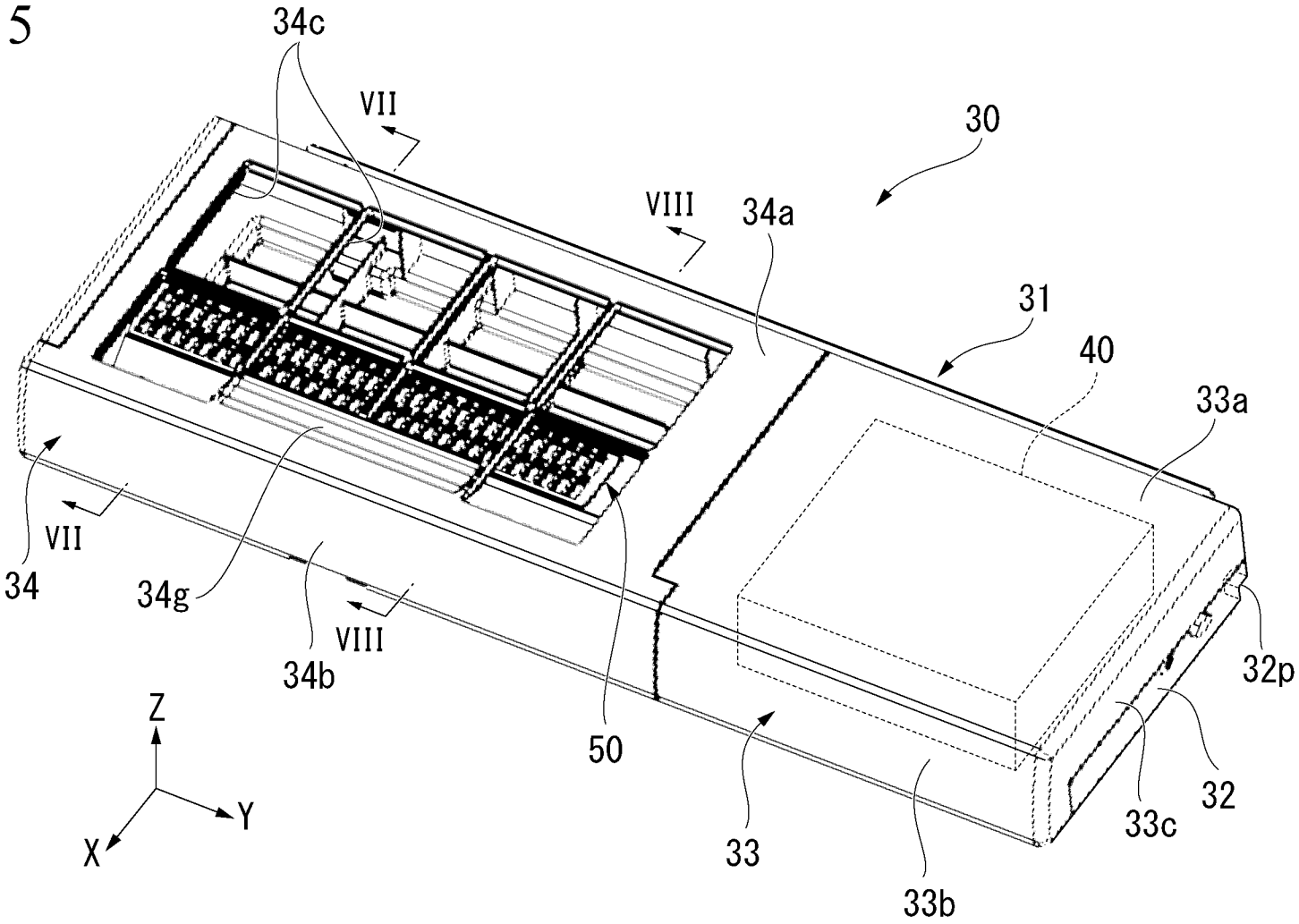
FIG. 5 is a perspective view showing the discharge unit in the embodiment.
Figure 6:
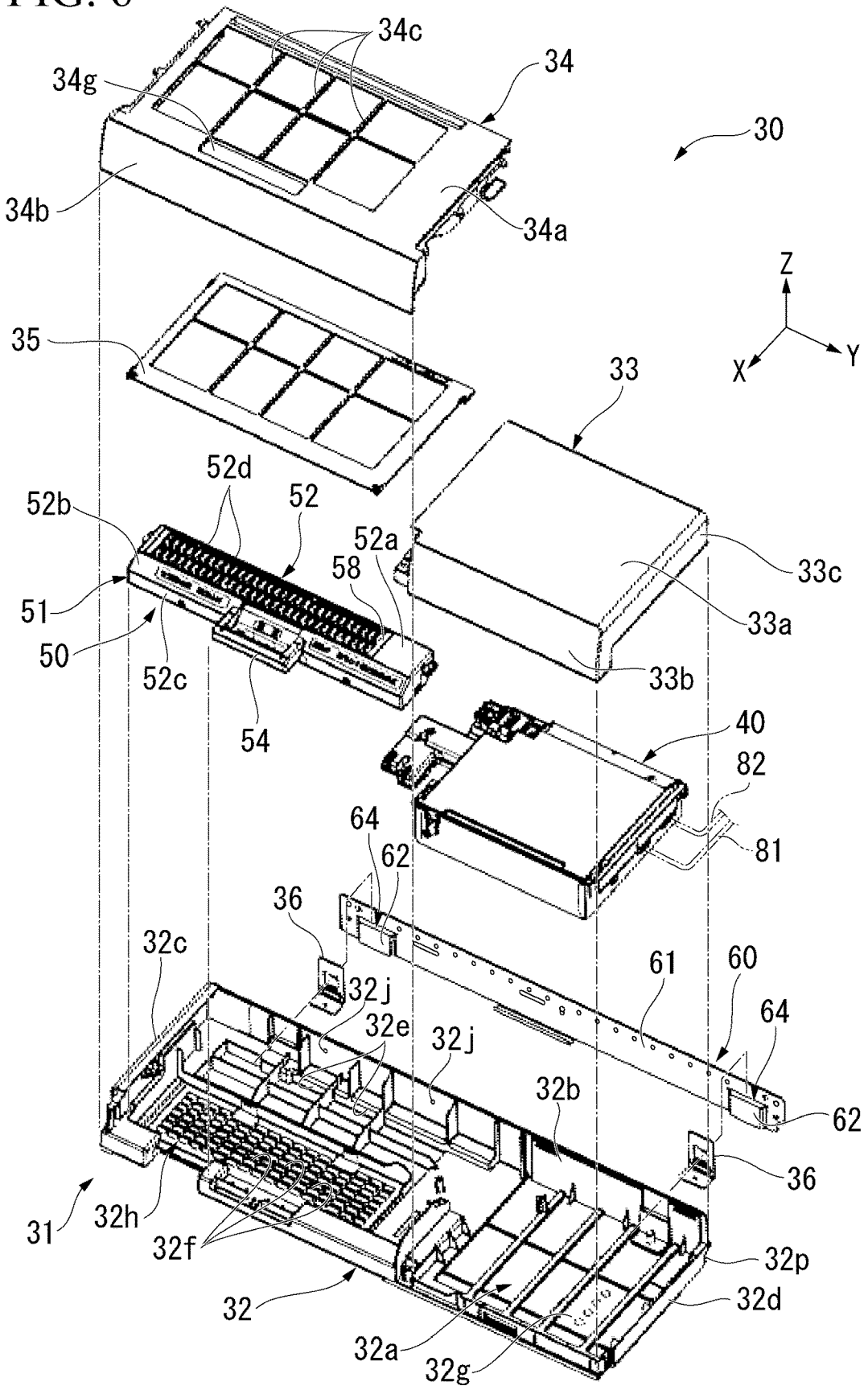
FIG. 6 is an exploded perspective view showing the discharge unit in the embodiment.
Figure 7:
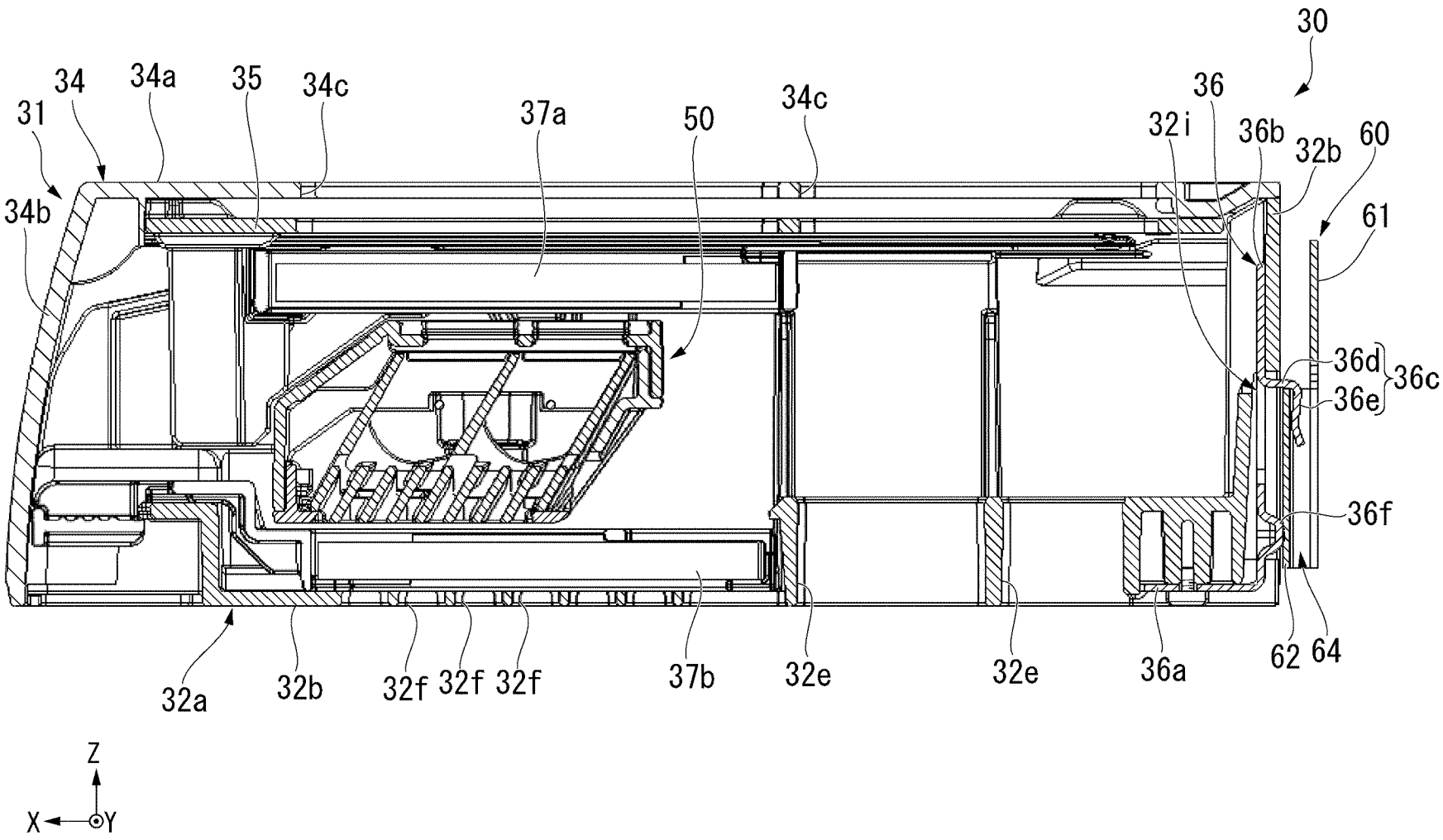
FIG. 7 is a cross-sectional view showing the discharge unit in the embodiment and taken along line VII-VII in FIG. 5.
Figure 8:
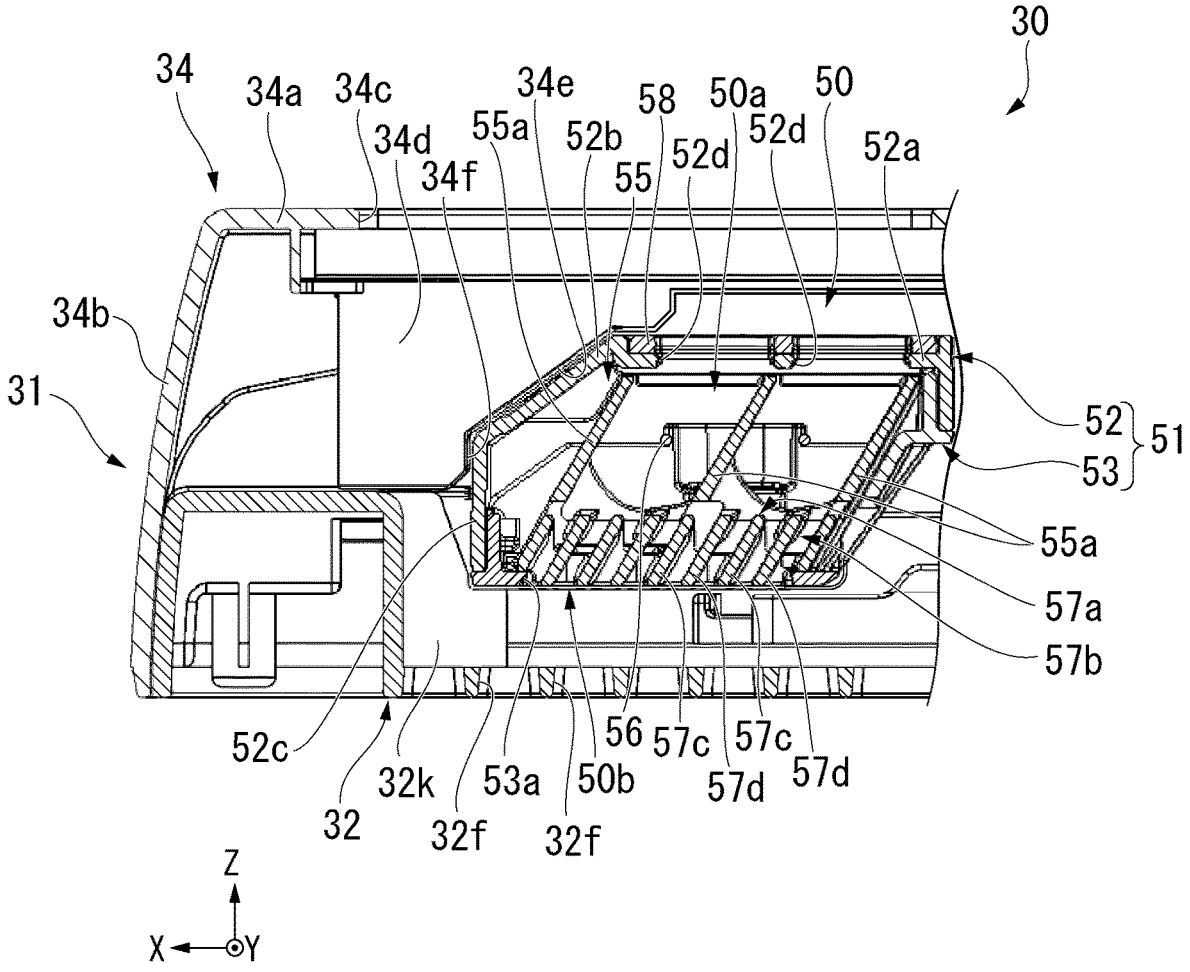
FIG. 8 is a cross-sectional view showing a portion of the discharge unit in the embodiment and taken along line VIII-VIII in FIG. 5.

FIG. 5 is a perspective view showing the discharge unit 30. FIG. 6 is an exploded perspective view showing the discharge unit 30. FIG. 7 is a cross-sectional view showing the discharge unit 30 and taken along line VII-VII in FIG. 5. FIG. 8 is a cross-sectional view showing a portion of the discharge unit 30 and taken along line VIII-VIII in FIG. 5.

As shown in FIG. 5, the discharge unit 30 has a substantially rectangular parallelepiped shape extending in the right-left direction and flattened in the vertical direction. As shown in FIG. 2, in the right-left direction of the indoor unit 20, the center of the discharge unit 30 is disposed to be shifted to the left side (+Y side) in the right-left direction with respect to the center of the indoor unit 20. The dimension of the discharge unit 30 in the right-left direction is smaller than the dimension of the indoor unit 20 in the right-left direction. In the present embodiment, the dimension of the discharge unit 30 in the right-left direction is at least half the dimension of the indoor unit 20 in the right-left direction. The left end portion of the discharge unit 30 is disposed at the same position in the right-left direction as the left end portion of the indoor unit 20. Note that "the left end portion of the discharge unit 30 is disposed at the same position in the right-left direction as the left end portion of the indoor unit 20" also includes a case where the position in the right-left direction at the left end portion of the discharge unit 30 is slightly shifted with respect to the position in the right-left direction at the left end portion of the indoor unit 20 due to dimensional tolerance, assembly tolerance, or the like.

As shown in FIG. 6, the discharge unit 30 includes a case 31, a pre-filter 35, a second control unit 40, a discharge device 50, a signal wiring 81, and a power supply wiring 82.

The case 31 accommodates the second control unit 40 and the discharge device 50 therein. The case 31 extends in the right-left direction. The case 31 is made of, for example, a resin. The case 31 includes a base member 32, and a control unit cover 33 and a discharge device cover 34 attached above the base member 32. The base member 32 includes a substantially rectangular bottom wall portion 32*a* elongated in the right-left direction, a rear wall portion 32*b* protruding upward from a rear-side (−X side) edge portion of the bottom wall portion 32*a*, a right wall portion 32*c* protruding upward from a right-side (−Y side) edge portion of the bottom wall portion 32*a*, and a left wall portion 32*d* protruding upward from a left-side (+Y side) edge portion of the bottom wall portion 32*a*.

The bottom wall portion 32*a* has a plate shape with a plate surface facing the vertical direction. The bottom wall portion 32*a* includes a first fixed portion 32*g* to which the second control unit 40 is fixed, and a second fixed portion 32*h* to which the discharge device 50 is fixed. The first fixed portion 32*g* supports the second control unit 40 from below. The second fixed portion 32*h* supports the discharge device 50 from below.

The first fixed portion 32*g* is a portion on the left side (+Y side) of the bottom wall portion 32*a*. No through hole is provided in the first fixed portion 32*g*. For this reason, the air AF cannot pass through the first fixed portion 32*g* in the vertical direction.

The second fixed portion 32*h* is a front-side (+X side) portion of a right-side (−Y side) portion of the bottom wall portion 32*a*. The second fixed portion 32*h* is provided with a ventilation hole 32*f* that penetrates the second fixed portion 32*h* in the vertical direction. A plurality of ventilation holes 32*f* are provided in a matrix in the front-rear direction and the right-left direction. Thereby, a portion of the second fixed portion 32*h* which is provided with the plurality of ventilation holes 32*f* has a lattice shape. Air AF can pass through the second fixed portion 32*h* in the vertical direction via the plurality of ventilation holes 32*f*.

A ventilation hole 32*e* is provided in a portion positioned on the rear side (−X side) of the second fixed portion 32*h* in the right-side (−Y side) portion of the bottom wall portion 32*a*. A plurality of ventilation holes 32*e* are provided in a matrix in the front-rear direction and the right-left direction. Thereby, a portion of the bottom wall portion 32*a* which is provided with the plurality of ventilation holes 32*e* has a lattice shape. An opening area of each ventilation hole 32*e* is larger than an opening area of each ventilation hole 32*f* provided in the second fixed portion 32*h*. That is, the opening area of each ventilation hole 32*f* provided in the second fixed portion 32*h* is smaller than the opening area of each ventilation hole 32*e*. For this reason, it is possible to prevent fingers of a user or the like from entering the case 31 from the lower side of the bottom wall portion 32*a* through the ventilation holes 32*f*. Thereby, it is possible to prevent the fingers of the user or the like from contacting the discharge device 50 supported by the second fixed portion 32*h*.

The control unit cover 33 is positioned above the first fixed portion 32*g* in the bottom wall portion 32*a*. The control unit cover 33 is positioned above the second control unit 40 and covers the second control unit 40 from above. The control unit cover 33 is fixed to the base member 32, for example, by screwing. The control unit cover 33 includes a top wall portion 33*a* having a substantially square shape when viewed in the vertical direction, a front wall portion 33*b* protruding downward from a front-side (+X side) edge portion of the top wall portion 33*a*, and a left wall portion 33*c* protruding downward from a left-side (+Y side) edge portion of the top wall portion 33*a*. No through hole is provided in the top wall portion 33*a*. For this reason, the air AF cannot pass through the top wall portion 33*a* in the vertical direction. The left wall portion 33*c* is disposed in contact with the left wall portion 32*d* of the base member 32 in the vertical direction. The front surface of the front wall portion 33*b* constitutes a left portion of the front surface of the case 31. The front surface of the front wall portion 33*b* is a design surface.

The discharge device cover 34 is positioned above a right-side (−Y side) portion of the bottom wall portion 32*a* which includes the second fixed portion 32*h*. The discharge device cover 34 is positioned above the discharge device 50. As shown in FIG. 5, the discharge device cover 34 is adjacent to the right side (−Y side) of the control unit cover 33. The dimension of the discharge device cover 34 in the right-left direction is larger than the dimension of the control unit cover 33 in the right-left direction. The discharge device cover 34 includes a substantially rectangular top wall portion 34*a* when viewed in the vertical direction, a front wall portion 34*b* protruding downward from the front-side (+X side) edge portion of the top wall portion 34*a*, and a finger hook portion 34*g* provided in a front-side edge portion of the upper surface of the top wall portion 34*a*.

The top wall portion 34*a* is provided with ventilation holes 34*c* penetrating the top wall portion 34*a* in the vertical direction. The plurality of ventilation holes 34*c* are provided in a matrix in the front-rear direction and the right-left direction. Thereby, a portion of the top wall portion 34*a* which is provided with the plurality of ventilation holes 34*c* has a lattice shape. Air AF passes through the top wall portion 34*a* in the vertical direction through the plurality of ventilation holes 34*c*. The front surface of the front wall portion 34*b* constitutes the right-side (−Y side) portion of the front surface of the case 31. The front surface of the front wall portion 34*b* is a design surface.

The discharge device cover 34 is detachably attached to the base member 32. In the present embodiment, the discharge device cover 34 is detached from the base member 32 by being slid forward (+X direction). A user or the like can easily detach the discharge device cover 34, for example, by grasping the finger hook portion 34*g* and pulling the discharge device cover 34 forward.

A lead-out hole 32*p* is provided in a left-side (+Y side) end portion of the case 31. In the present embodiment, the lead-out hole 32*p* is provided in a rear-side (−X side) end portion of the left-side end portion of the case 31. The lead-out hole 32*p* is provided in the base member 32. The lead-out hole 32*p* connects the inside of the case 31 and the outside of the case 31.

As shown in FIG. 6, the pre-filter 35 is a substantially rectangular plate-shaped member. The pre-filter 35 is positioned above the discharge device 50. The pre-filter 35 is positioned vertically between the discharge device 50 and the discharge device cover 34. As shown in FIG. 7, the pre-filter 35 is attached to the lower surface of the top wall portion 34*a* in the discharge device cover 34.

The air AF flowing into the case 31 through the ventilation holes 34*c* of the top wall portion 34*a* from above the discharge unit 30 passes through the pre-filter 35 and then flows into the discharge device 50. The pre-filter 35 is a filter capable of catching relatively large dust such as fibers mixed in the air AF.

Although not shown in the drawing, rails for supporting the pre-filter 35 so as to be movable in the front-rear direction are provided at both edge portions in the right-left direction on the lower surface of the top wall portion 34*a*. A user or the like can attach the pre-filter 35 to the discharge device cover 34 by inserting the pre-filter 35 from the rear (−X direction) below the top wall portion 34*a*.

The discharge unit 30 includes rectifying filters 37*a* and 37*b*. The rectifying filter 37*a* is positioned between the pre-filter 35 and the discharge device 50 in the vertical direction. The rectifying filter 37*b* is positioned between the bottom wall portion 32*a* and the discharge device 50 in the vertical direction. The rectifying filters 37*a* and 37*b* are, for example, filters having honeycomb ventilation holes. Each of ventilation holes provided in the rectifying filters 37*a* and 37*b* is, for example, a regular hexagon with sides facing each other at a distance of approximately 6 mm. The rectifying filters 37*a* and 37*b* suitably transmit the air AF in the vertical direction through the ventilation holes.

The honeycomb-shaped rectifying filters 37*a* and 37*b* are made of, for example, a sheet-shaped aluminum alloy. Since the rectifying filters 37*a* and 37*b* are made of a metal, they are resistant to fire. Here, for example, all parts constituting the discharge device 50 are made of a flame retardant or a metal. By sandwiching the discharge device 50 between the honeycomb-shaped rectifying filters 37*a* and 37*b* made of a metal, even when the discharge device 50 ignites, it is possible to make fire less likely to reach the surrounding members and to secure time for self-extinguishing in the discharge device 50. The rectifying filter 37*b* disposed below the discharge device 50, that is, on the downstream side of the flow of the air AF, exhibits the above-described effect more effectively when the blower 23 of the indoor unit 20 suctions the air AF from the suction port 21*e*. The rectifying filter 37*a* disposed above the discharge device 50, that is, on the upstream side of the flow of the air AF, exhibits the above-described effect more effectively when the blower 23 is stopped.

As shown in FIG. 6, the discharge unit 30 includes a plurality of hook portions (attachment portions) 36. In the present embodiment, a pair of hook portions 36 are provided with an interval therebetween in the right-left direction. The hook portion 36 is attached to the rear side (−X side) of the base member 32. One hook portion 36 is attached across the first fixed portion 32*g* and the rear wall portion 32*b*. The other hook portion 36 is attached across the rear wall portion 32*b* and a portion of the bottom wall portion 32*a* which is positioned behind the second fixed portion 32*h*.

In the present embodiment, the hook portion 36 is an L-shaped sheet metal member. As shown in FIG. 7, the hook portion 36 includes a support portion 36*a* extending in the front-rear direction, an extending portion 36*b* extending upward from a rear-side (−X side) end portion of the support portion 36*a*, and a claw portion 36*c* protruding rearward from the extending portion 36*b*.

The support portion 36*a* is screwed to the lower surface of the bottom wall portion 32*a*. The support portion 36*a* protrudes further forward than an engaging portion 62, which will be described later, and supports the case 31 from below. A portion of the bottom wall portion 32*a* to which the support portion 36*a* is fixed is recessed upward. The support portion 36*a* is positioned above the lower end surface of the case 31.

The upper portion of the extending portion 36*b* is inserted into a slit portion 32*i*, which is provided in the rear wall portion 32*b* of the base member 32, from below and is inserted into the case 31. The upper portion of the extending portion 36*b* contacts the front surface of the rear wall portion 32*b* from the front (+X direction). A protruding portion 36*f* protruding rearward (−X direction) is provided in a portion of the extending portion 36*b* which is positioned below the claw portion 36*c*. The protruding portion 36*f* is formed by bending a portion of the extending portion 36*b* rearward. A rear-side end portion of the protruding portion 36*f* is in contact with a front surface of the engaging portion 62, which will be described later.

The claw portion 36*c* includes a base portion 36*d* protruding rearward (−X direction) from the extending portion 36*b*, and a claw body portion 36*e* protruding downward from a rear-side end portion of the base portion 36*d*. The base portion 36*d* protrudes rearward from a portion of the extending portion 36*b* which is positioned below the portion inserted into the case 31. The claw body portion 36*e* is inserted into a hole portion 64, which will be described later, from above and hooked on the engaging portion 62 from behind. In the present embodiment, the claw portion 36*c* is formed by cutting and raising a portion of the extending portion 36*b* rearward.

An upper end portion of the hook portion 36 is positioned below an upper end portion of the case 31. A lower end portion of the hook portion 36 is positioned above a lower end portion of the case 31. That is, the hook portion 36 is disposed to fall within the dimensions of the case 31 in the vertical direction.

The second control unit 40 is a control unit that controls the discharge device 50. As shown in FIG. 2, the second control unit 40 is positioned on the left side (+Y side) of the discharge device 50. At least a portion of the second control unit 40 is disposed to be superimposed above the first control unit 24. In the present embodiment, the left-side portion of the second control unit 40 is positioned above the first control unit 24.

Figure 9:
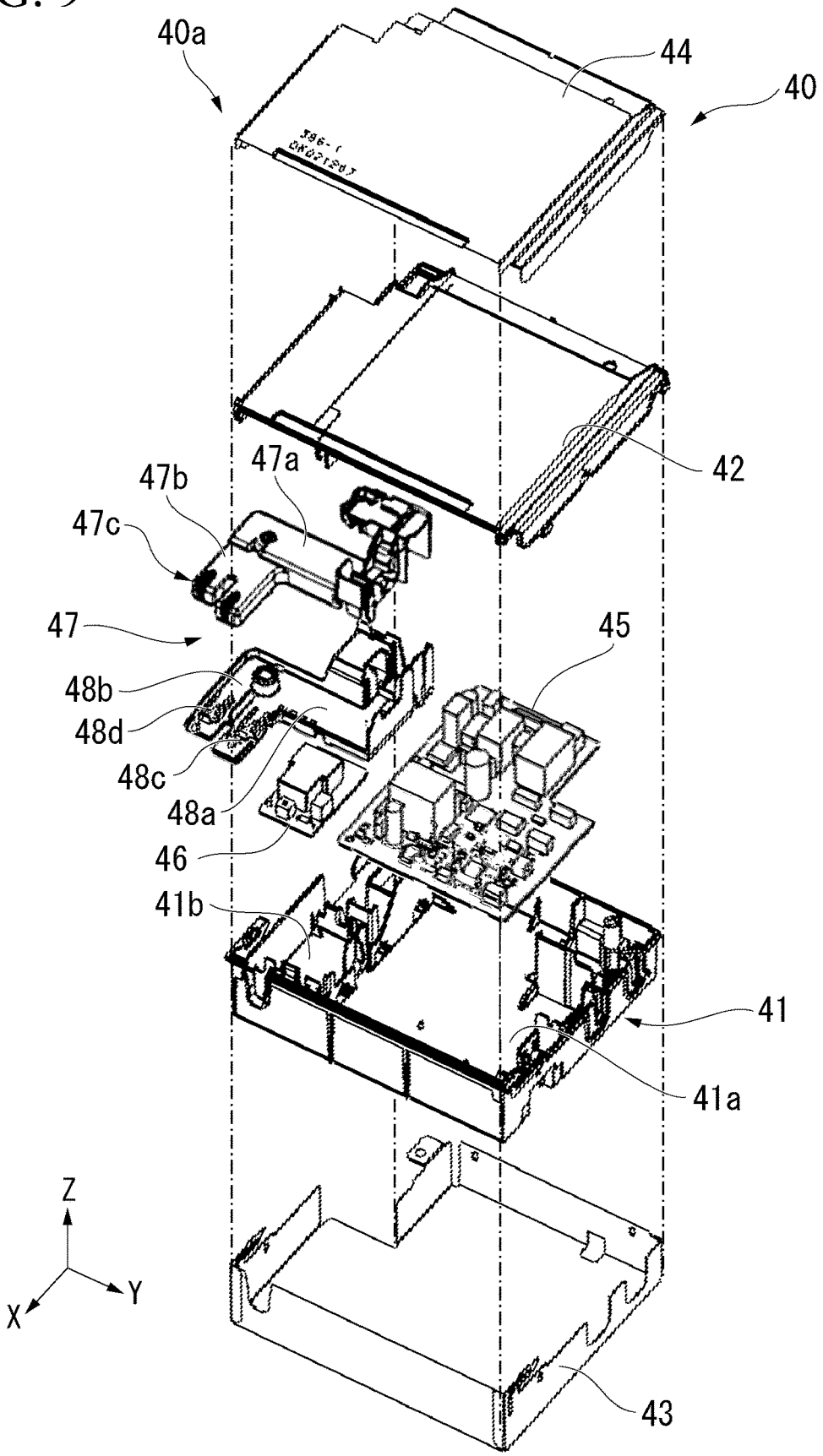
FIG. 9 is an exploded perspective view showing a second control unit in the embodiment.
Figure 10:
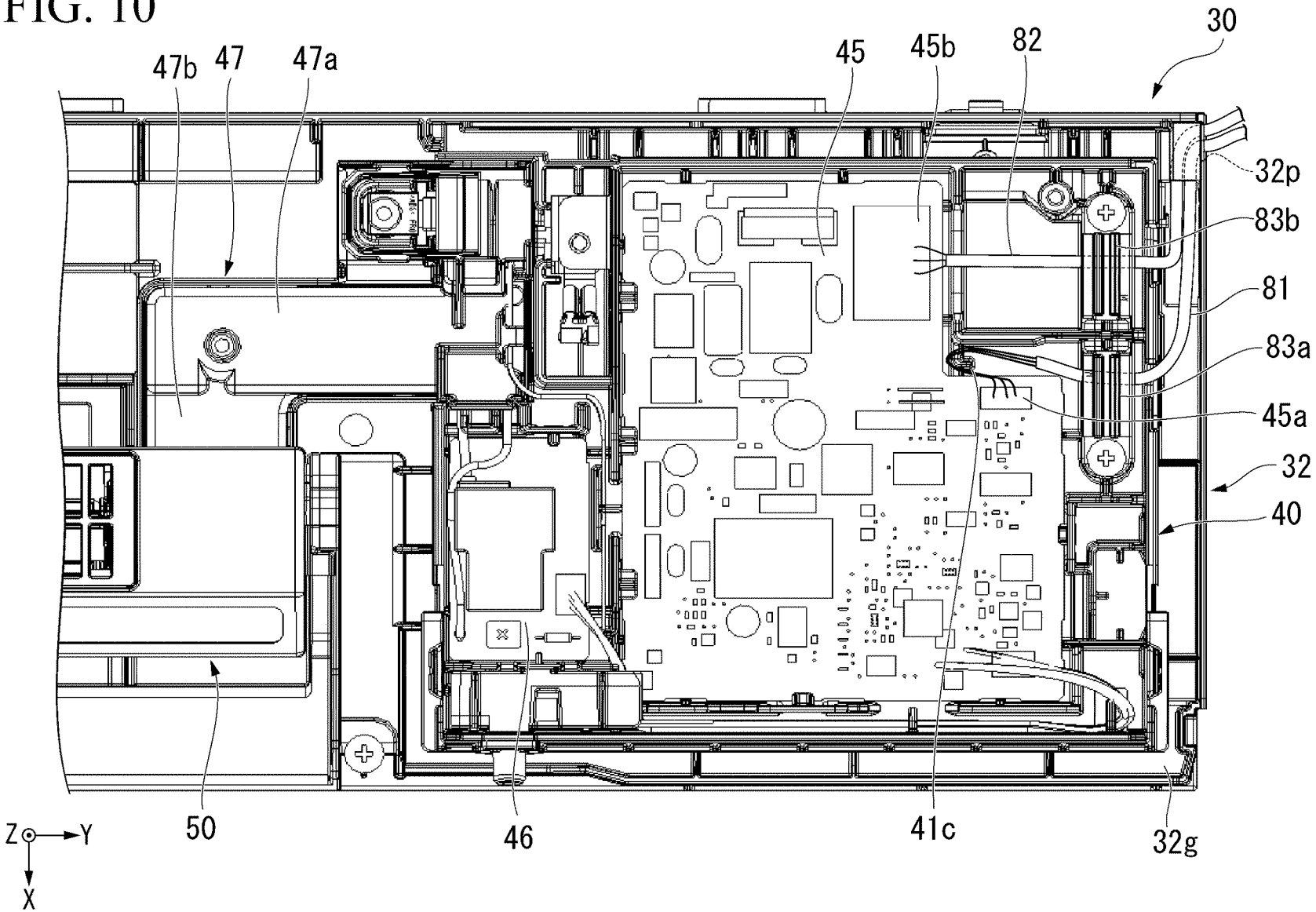
FIG. 10 is a top view of a portion of the second control unit in the embodiment.
Figure 11:
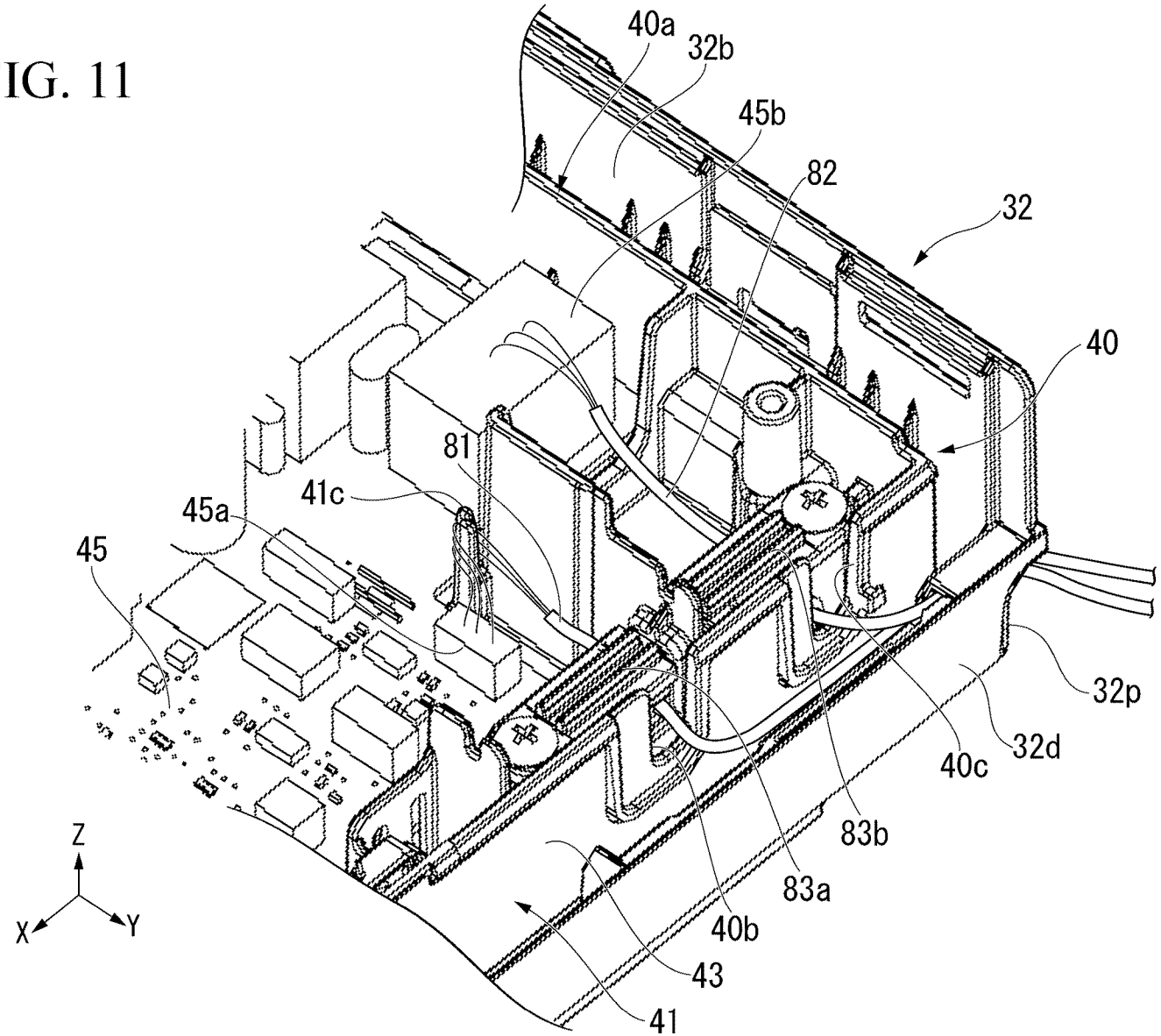
FIG. 11 is a perspective view showing a portion of the second control unit in the embodiment.

FIG. 9 is an exploded perspective view showing the second control unit 40. FIG. 10 is a top view of a portion of the second control unit 40. FIG. 11 is a perspective view showing a portion of the second control unit 40. As shown in FIG. 9, the second control unit 40 includes a substrate case 40*a*, a control substrate 45 and a boosting substrate 46 that are accommodated in the substrate case 40*a*, and a terminal portion 47.

The substrate case 40*a* includes a box-shaped lower resin cover 41 that opens upward, an upper resin cover 42 fixed above the lower resin cover 41, a lower sheet metal cover 43 positioned below the lower resin cover 41, and an upper sheet metal cover 44 positioned above the upper resin cover 42. The lower sheet metal cover 43 has a box shape that opens upward and covers the lower resin cover 41. The upper sheet metal cover 44 is fixed above the lower sheet metal cover 43 and covers the upper resin cover 42.

The lower resin cover 41 includes a control substrate fixing portion 41*a* to which the control substrate 45 is fixed, and a boosting substrate fixing portion 41*b* to which the boosting substrate 46 is fixed. The boosting substrate fixing portion 41*b* is connected to the right side (−Y side) of the front side (+X side) portion of the control substrate fixing portion 41*a*.

As shown in FIGS. 10 and 11, terminal blocks 45*a* and 45*b* are mounted on the control substrate 45. A signal wiring 81 is connected to the terminal block 45*a*. A power supply wiring 82 is connected to the terminal block 45*b*. The terminal block 45*b* is positioned on the right side (−Y direction) and the rear side (−X direction) of the terminal block 45*a*.

As shown in FIG. 11, the signal wiring 81 is hooked on a protruding portion 41*c* inside the substrate case 40*a*. The protruding portion 41*c* protrudes upward from the bottom of the lower resin cover 41. The protruding portion 41*c* is positioned to the right side (−Y direction) and the rear side (−X direction) of the terminal block 45*a*. The signal wiring 81 extends rightward from the terminal block 45*a*, is hooked on the protruding portion 41*c* from the right side, and is folded back leftward (+Y direction). The signal wiring 81 folded back leftward extends leftward and is led out from the substrate case 40*a* from a penetration portion 40*b* provided on a left wall portion of the substrate case 40*a*.

In this manner, the signal wiring 81 is connected to the second control unit 40 via the penetration portion 40*b* from the left side (+Y side). The penetration portion 40*b* penetrates the left wall portion of the lower resin cover 41 and the left wall portion of the lower sheet metal cover 43 in the right-left direction. The penetration portion 40*b* opens upward. A portion of the signal wiring 81 is fixed from above by a clamp member 83*a* inside the substrate case 40*a*.

The signal wiring 81 led out from the substrate case 40*a* extends rearward (−X direction) through a gap between the substrate case 40*a* and the case 31 in the right-left direction and is led out of the discharge unit 30 from the lead-out hole 32*p*. As shown in FIG. 2, the signal wiring 81 led out from the discharge unit 30 passes between the indoor unit 20 and the wall surface Ws, is inserted into the indoor unit housing 21, and is electrically connected to a connection portion 24*a* of the first control unit 24 from the left side (+Y side). Thereby, the signal wiring 81 electrically connects the discharge device 50 and the first control unit 24.

Although not shown in the drawing, the power supply wiring 82 includes a power supply line and a ground line. As shown in FIG. 11, the power supply wiring 82 extends leftward (+Y direction) from the terminal block 45*b* and is led out from the substrate case 40*a* from a penetration portion 40*c* provided in the left wall portion of the substrate case 40*a*. In this manner, the power supply wiring 82 is connected to the second control unit 40 from the left side through the penetration portion 40*c*. The penetration portion 40*c* penetrates the left wall portion of the lower resin cover 41 and the left wall portion of the lower sheet metal cover 43 in the right-left direction. The penetration portion 40*c* opens upward. The penetration portion 40*c* is positioned separately behind (−X direction) the penetration portion 40*b*. A portion of the power supply wiring 82 is fixed from above by a clamp member 83*b* inside the substrate case 40*a*.

The power supply wiring 82 led out from the substrate case 40*a* extends rearward (−X direction) through a gap between the substrate case 40*a* and the case 31 in the right-left direction and is led out of the discharge unit 30 from the lead-out hole 32*p*. As shown in FIG. 2, a portion of the power supply wiring 82 led out from the discharge unit 30 passes between the indoor unit 20 and the wall surface Ws. The power supply wiring 82 is connected to a power source separate from the indoor unit 20, for example, via a plug socket, which is not shown in the drawing, provided on the wall surface Ws.

The control substrate 45 and the boosting substrate 46 are electrically connected to each other via a wiring. The control substrate 45 converts, for example, an AC voltage of 200 V (volt) or more and 240 V (volt) or less applied from a power line of the power supply wiring 82 into a relatively low DC voltage of approximately 12 V (volt). The boosting substrate 46 converts, for example, the DC voltage converted by the control substrate 45 into a relatively high DC voltage of approximately 6000 V (volt). Although not shown in the drawing, a pair of wirings electrically connected to a pair of terminals 48*c* and 48*d* provided in the terminal portion 47 are connected to the boosting substrate 46.

As shown in FIG. 9, the terminal portion 47 has a substantially L shape including a first extending portion 47*a* extending rightward (−Y direction) from the rear-side (−X direction) of the boosting substrate 46, and a second extending portion 47*b* extending forward (+X direction) from a right-side end portion of the first extending portion 47*a*. The terminal portion 47 includes a pair of wiring members 48*a* and 48*b*, a pair of terminals 48*c* and 48*d* electrically connected to the pair of wiring members 48*a* and 48*b*, respectively, and a holding member 47*c* that holds the pair of wiring members 48*a* and 48*b*. The holding member 47*c* is constituted by a pair of resin members that sandwich the pair of wiring members 48*a* and 48*b* in the vertical direction.

The terminal 48*c* is electrically connected to the boosting substrate 46 via the wiring member 48*a*. The terminal 48*d* is electrically connected to the boosting substrate 46 via the wiring member 48*b*. One of the pair of terminals 48*c*, 48*d* is a high voltage terminal, and the other is a low voltage terminal. The low voltage terminal is grounded. The pair of terminals 48*c* and 48*d* are made of, for example, spring steel. The pair of terminals 48*c* and 48*d* are disposed at a front-side (+X side) end portion of the second extending portion 47*b*.

As shown in FIG. 3, the discharge device 50 is disposed above the suction port 21*e* provided in the indoor unit 20. As shown in FIG. 6, the discharge device 50 has a substantially rectangular parallelepiped shape extending in the right-left direction and flattened in the vertical direction. As shown in FIG. 8, the discharge device 50 in the present embodiment is an electric dust collector including a discharge portion 50*a* and a dust collecting portion 50*b*.

The discharge portion 50*a* includes a discharge electrode 56 and a counter electrode 55. The discharge electrode 56 is a metal wire. The counter electrode 55 is constituted by a plurality of flat plate-shaped electrodes 55*a*. The plurality of flat plate-shaped electrodes 55*a* are arranged side by side with gaps therebetween in the front-rear direction. The discharge electrode 56, which is a wire, passes between the flat plate-shaped electrodes 55*a* adjacent to each other. In the present embodiment, the number of flat plate-shaped electrodes 55*a* is three. The discharge electrode 56 passes between the flat plate-shaped electrode 55*a* positioned on the frontmost side and the flat plate-shaped electrode 55*a* positioned at an intermediate location, is folded back, and passes between the flat plate-shaped electrode 55*a* positioned at an intermediate location and the flat plate-shaped electrode 55*a* positioned on the rearmost side. Note that the number of flat plate-shaped electrodes 55*a* can be changed as appropriate. The number of times the discharge electrode 56 is folded back can be changed in accordance with the number of flat plate-shaped electrodes 55*a*.

In the discharge portion 50*a*, different voltages are applied to the discharge electrode 56 and the counter electrode 55, thereby causing discharge and an electric field. This discharge and electric field can charge particles in the air AF passing through the discharge portion 50*a*. The particles in the air AF include, for example, dust, bacteria, mold, viruses, and allergens. In addition, the discharge and electric field occurring in the discharge portion 50*a* act on bacteria, mold, viruses, and the like in the air AF passing through the discharge portion 50*a*, so that the bacteria, mold, viruses, and the like can be inactivated.

The voltage applied to the discharge electrode 56 is relatively high. Specifically, for example, a DC voltage of 4000 V (volt) or more and 6000 V (volt) or less is applied to the discharge electrode 56. The voltage applied to the counter electrode 55 is relatively low. Specifically, for example, a voltage of 0 V (volt) is applied to the counter electrode 55. That is, the counter electrode 55 is grounded in the present embodiment.

The dust collecting portion 50*b* is disposed below the discharge portion 50*a*, that is, on the downstream side of the discharge portion 50*a* in a direction in which the air AF flows. The dust collecting portion 50*b* includes a first electrode 57*a* and a second electrode 57*b*. The first electrode 57*a* is configured by connecting a plurality of first flat plate-shaped electrodes 57*c* with a connecting member which is not shown in the drawing. The second electrode 57*b* is configured by connecting a plurality of second flat plate-shaped electrodes 57*d* with a connecting member which is not shown in the drawing. The plurality of first flat plate-shaped electrodes 57*c* and the plurality of second flat plate-shaped electrodes 57*d* are arranged side by side with gaps therebetween in the front-rear direction. The first flat plate-shaped electrodes 57*c* and the second flat plate-shaped electrodes 57*d* are alternately arranged in the front-rear direction.

The dust collecting portion 50*b* generates an electrostatic force by applying different voltages to the first electrode 57*a* and the second electrode 57*b* from the second control unit 40 via a pair of terminals which are not shown in the drawing. The dust collecting portion 50*b* can collect particles charged in the discharge portion 50*a* by the electrostatic force.

The voltage applied to the first electrode 57*a* is relatively high. Specifically, for example, a DC voltage of 4000 V (volt) or more and 6000 V (volt) or less is applied to the first electrode 57*a*. The voltage applied to the second electrode 57*b* is relatively low. Specifically, for example, a voltage of 0 V (volt) is applied to the second electrode 57*b*. That is, the second electrode 57*b* is grounded in the present embodiment.

The first electrode 57*a* is made of an antistatic resin having electrical conductivity and a resistance value of $10^{12}$ $\Omega/cm^2$ (ohms per square centimeter) or less. The second electrode 57*b* is formed by plating a resin with a metal. The second electrode 57*b* may be formed of a metal plate such as stainless steel, or may be formed of a conductive resin in which carbon is kneaded and of which the resistance value is $10^4$ $\Omega/cm^2$ (ohms per square centimeter) or less.

The discharge device 50 includes a discharge device case 51 that accommodates the discharge portion 50*a* and the dust collecting portion 50*b* therein. The discharge device case 51 includes an upper case 52 and a lower case 53 positioned below the upper case 52. The upper case 52 and the lower case 53 are fixed to each other.

The upper case 52 includes a top wall portion 52*a* positioned above, an inclined wall portion 52*b* extending forward and obliquely downward from a front-side (+X side) edge portion of the top wall portion 52*a*, and a front wall portion 52*c* extending downwardly from a front-side edge portion of the inclined wall portion 52*b*. An opening 52*d* is provided in the top wall portion 52*a*. As shown in FIG. 6, a plurality of openings 52*d* are provided in a matrix in the front-rear direction and the right-left direction. Thereby, a portion of the top wall portion 52*a* which is provided with the plurality of openings 52*d* has a lattice shape. A pre-filter 58 is attached to the upper surface of the top wall portion 52*a*. The pre-filter 58 covers the openings 52*d* from above. A handle portion 54 protruding forward is provided at a central portion in the right-left direction of the front-side (+X side) portion of the upper case 52.

As shown in FIG. 8, the lower case 53 is provided with an opening 53*a*. Air AF that has flowed into the discharge device case 51 through the openings 52*d* of the upper case 52 passes through the discharge portion 50*a* and the dust collecting portion 50*b* in this order, and flows out of the discharge device case 51 from the opening 53*a*. Thereby, the air AF that has been cleaned by the dust collecting portion 50*b* capturing dust is discharged from the lower side of the discharge device 50. The cleaned air AF discharged from the lower side of the discharge device 50 is discharged below the discharge unit 30 through the ventilation holes 32*f* of the case 31 and suctioned into the indoor unit 20 from the suction port 21*e*.

In the present embodiment, the discharge device 50 is supported from below by a support convex portion 32*k* provided in the base member 32 of the case 31 of the discharge unit 30. The support convex portion 32*k* protrudes upward from the bottom wall portion 32*a*. The support convex portion 32*k* supports the front-side (+X side) end portion of the discharge device 50 from below.

The discharge device 50 is pressed from above and from the front (+X direction) by the protruding portion 34*d* provided in the discharge device cover 34. The protruding portion 34*d* protrudes downward from the top wall portion 34*a* of the discharge device cover 34. The protruding portion 34*d* is positioned above and in front of the front-side portion of the discharge device 50. The protruding portion 34*d* has a substantially triangular shape when viewed in the right-left direction.

The protruding portion 34*d* includes an inclined surface 34*e* and a rear surface 34*f*. The inclined surface 34*e* faces downward and obliquely rearward (−X direction), and is disposed to face the upper side of the inclined wall portion 52*b*. The inclined surface 34*e* is along the outer surface of the inclined wall portion 52*b* and is in contact with the outer surface of the inclined wall portion 52*b*. The rear surface 34*f* extends downward from the front-side end portion of the inclined surface 34*e*. The rear surface 34*f* faces rearward and is disposed to face the front of the upper portion of the front wall portion 52*c*. The rear surface 34*f* is along the outer surface of the front wall portion 52*c* and is in contact with the outer surface of the front wall portion 52*c*.

As shown in FIG. 10, the left-side (+Y side) end portion of the discharge device 50 is disposed to be superimposed above the front-side (+X side) end portion of the second extending portion 47*b* in the terminal portion 47 of the second control unit 40. Although not shown in the drawing, a pair of terminals are provided on the lower surface of the left-side end portion of the discharge device 50. The pair of terminals are electrically connected to the pair of terminals 48*c* and 48*d* provided in the terminal portion 47 by the discharge device 50 being disposed inside the case 31. Thereby, a high voltage can be applied from the second control unit 40 to the discharge device 50 via the terminal portion 47.

In the present embodiment, the discharge device 50 is detachably accommodated in the case 31 with the discharge device cover 34 removed. Although not shown in the drawing, both ends of the discharge device 50 in the right-left direction are supported by a pair of rails provided separately in the right-left direction inside the case 31 so as to be slidable in the front-rear direction. With the discharge device cover 34 detached, the discharge device 50 is exposed to the outside of the discharge unit 30. The discharge device 50 is slidable forward in a state where the discharge device cover 34 is detached from the case 31. After detaching the discharge device cover 34, a user or the like can detach the discharge device 50 from the case 31 by grasping the handle portion 54 and pulling the discharge device 50 forward (+X direction). In addition, the discharge device 50 can be attached to the inside of the case 31 by sliding the discharge device 50 from the front to the rear along the rails provided in the case 31 and inserting it. By inserting the discharge device 50 to the deepest part, a pair of terminals of the discharge device 50 which are not shown in the drawing are electrically connected to the pair of terminals 48*c* and 48*d* of the second control unit 40.

Since the discharge device 50 is detachable in this manner, the user or the like can clean the discharge device 50 with water or the like to easily remove dust collected in the dust collecting portion 50*b*. The discharge device 50 does not need to be replaced unlike an air cleaning filter or the like, and can be used repeatedly by cleaning as described above. By cleaning the dust collecting portion 50*b*, the performance of the discharge device 50 can be maintained at the initial performance without deteriorating the electrical characteristics of the discharge device 50 due to a voltage and a current.

The discharge device 50 is driven based on a signal received from the first control unit 24. The discharge device 50 is driven in association with the blower 23 of the indoor unit 20. The first control unit 24 transmits a signal for driving the discharge device 50 to the second control unit 40 of the discharge unit 30 together with a signal for driving the blower 23. Thereby, when air AF starts to be drawn into the indoor unit 20 by the blower 23, electric power is also supplied from the second control unit 40 to the discharge device 50.

At least a portion of the air AF suctioned into the suction port 21*e* by driving the blower 23 as shown in FIG. 3 passes through the discharge device 50 and then is suctioned into the suction port 21*e*. In the present embodiment, a portion of the air AF suctioned into the suction port 21*e* passes through the discharge device 50 and is suctioned into the suction port 21*e*, and the other portion of the air AF is suctioned into the suction port 21*e* without passing through the discharge device 50. The air AF can be cleaned as described above by passing through the discharge device 50. Thus, the indoor air AF can be purified by continuously operating the indoor unit 20.

The air conditioner 100 includes a first mounting member 28 and a second mounting member 60. The first mounting member 28 and the second mounting member 60 are fixed to the wall surface Ws. The first mounting member 28 and the second mounting member 60 are separate members. The first mounting member 28 is a back plate to which the indoor unit 20 is attached. The second mounting member 60 is a back plate to which the discharge unit 30 is attached. The first mounting member 28 is, for example, screwed to the wall surface Ws. The indoor unit 20 is attached to the wall surface Ws via the first mounting member 28.

The second mounting member 60 is fixed above the first mounting member 28 on the wall surface Ws. As shown in FIG. 4, the second mounting member 60 has a substantially rectangular plate shape extending in the right-left direction. The second mounting member 60 includes a substantially rectangular plate-shaped back plate portion 61 extending in the right-left direction, a plurality of engaging portions 62 protruding forward (+X direction) from the back plate portion 61, and a positioning convex portion 63 protruding downward from the central portion of the back plate portion 61 in the right-left direction and extending in the right-left direction.

The plate surface of the back plate portion 61 faces in the front-rear direction. A rear-side (−X side) surface of the back plate portion 61 is in contact with the wall surface Ws. In the present embodiment, the back plate portion 61 is configured such that both ends in the right-left direction and the central portion in the right-left direction are fixed to the wall surface Ws by a screw 70. The back plate portion 61 has an elongated hole 61*a* that penetrates the back plate portion 61 in the front-rear direction. The elongated hole 61*a* extends in the right-left direction. A pair of elongated holes 61*a* are disposed at an interval in the right-left direction. The pair of elongated holes 61*a* are provided in a right-side (−Y side) portion of the back plate portion 61. A screw 72 for fixing the rear wall portion 32*b* of the case 31 of the discharge unit 30 to the wall surface Ws passes through each of the elongated holes 61*a*.

The screw 72 passes through a through hole 32*j* provided in the rear wall portion 32*b* from the front thereof and is screwed into the wall surface Ws through the elongated hole 61*a*. The through holes 32*j* are a pair of circular holes that are provided at an interval in the right-left direction. The pair of through holes 32*j* are provided in the right-side portion of the rear wall portion 32*b*. The case 31 is fixed to the back plate portion 61 by the screws 72. In this manner, the peripheral edge portion of the through hole 32*j* in the rear wall portion 32*b* is a screwing portion (attachment portion) 32*r* that is screwed to the second mounting member 60. In a state where the discharge device cover 34 and the discharge device 50 are detached from the base member 32, the through hole 32*j* and the screwing portion 32*r* are exposed forward. For this reason, in a state where the discharge device cover 34 and the discharge device 50 are detached from the base member 32, an operator or the like can easily fix the screwing portion 32*r* to the second mounting member 60 with the screws 72.

Note that the back plate portion 61 may be provided with a through hole similar to the through hole 32*j* provided in the rear wall portion 32*b* instead of the elongated hole 61*a*. In this case, an elongated hole similar to the elongated hole 61*a* may be provided in the rear wall portion 32*b* instead of the through hole 32*j*.

The plurality of engaging portions 62 are provided at intervals in the right-left direction. In the present embodiment, one engaging portion 62 is provided on each of both ends of the back plate portion 61 in the right-left direction. The engaging portion 62 is formed, for example, by cutting and raising a portion of the back plate portion 61 forward (+X direction). By forming the engaging portion 62 in this manner, a hole portion 64 that opens upward is provided behind (−X direction) the engaging portion 62. The hole portion 64 also opens downward. The claw portion 36*c* is hooked on the engaging portion 62 by inserting the claw body portion 36*e* of the hook portion 36 into the hole portion 64 from above. The upper end portion of the engaging portion 62 is positioned below the upper end portion of the back plate portion 61. The lower end portion of the engaging portion 62 is positioned at the same position as the lower end portion of the back plate portion 61 in the vertical direction. That is, the engaging portion 62 is disposed to fall within the dimensions of the back plate portion 61 in the vertical direction.

In the present embodiment, the two hook portions 36 are hooked on the two engaging portions 62, respectively, and the screwing portion 32*r* is fixed to the back plate portion 61 by the screws 72, so that the discharge unit 30 is attached to the second mounting member 60. That is, in the present embodiment, the discharge unit 30 is attached to the second mounting member 60 via the screwing portion 32*r* and the hook portion 36 as attachment portions attached to the wall surface Ws.

Figure 12:
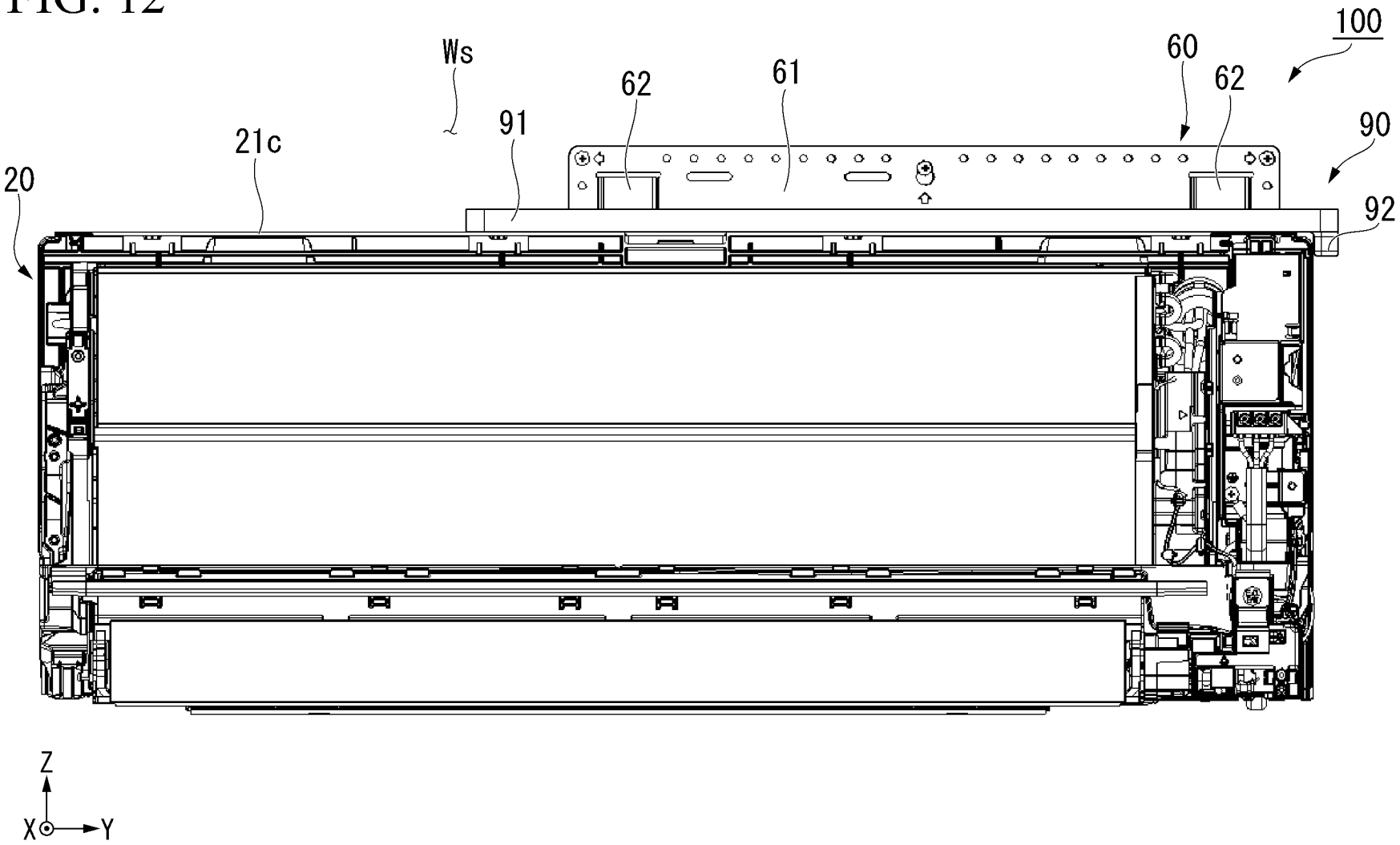
FIG. 12 is a front view of a state where a second mounting member is fixed to a wall surface in the embodiment.
Figure 13:
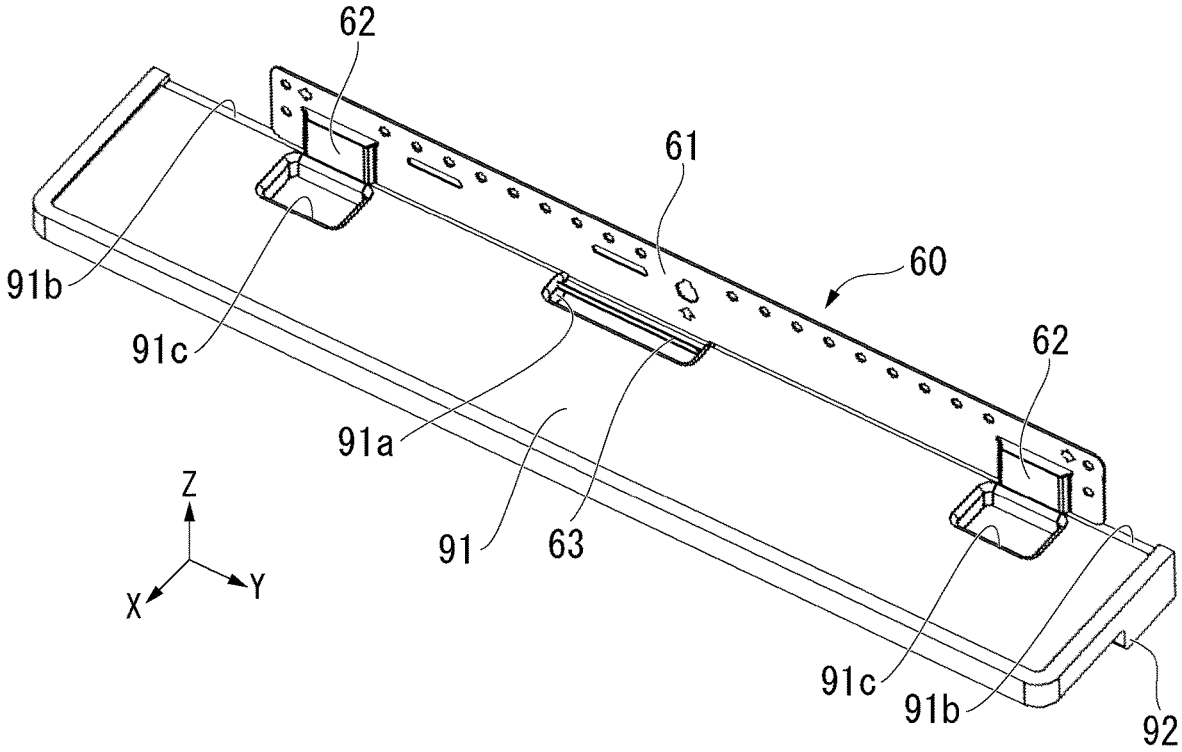
FIG. 13 is a perspective view showing a state when the second mounting member is fixed to the wall surface in the embodiment.
Figure 14:
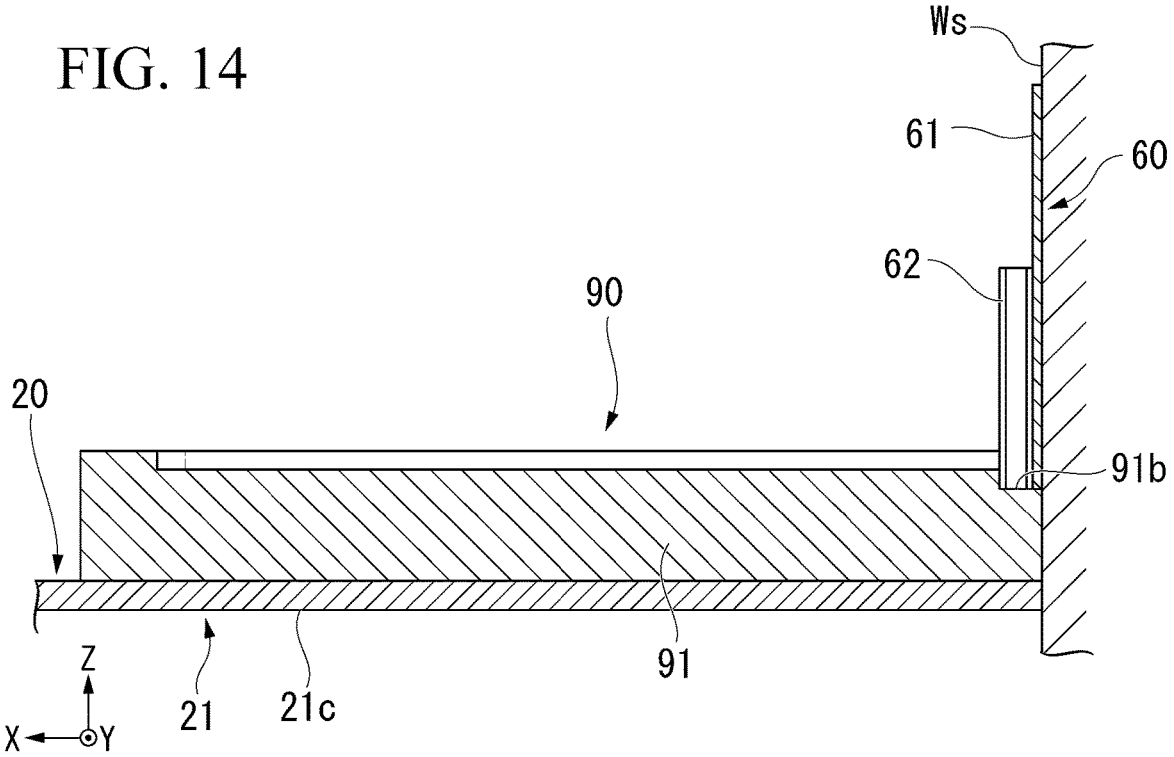
FIG. 14 is a sectional view showing a state when the second mounting member is fixed to the wall surface in the embodiment.

FIG. 12 is a front view of a state where the second mounting member 60 is fixed to the wall surface Ws. FIG. 13 is a perspective view showing a state where the second mounting member 60 is fixed to the wall surface Ws. FIG. 14 is a cross-sectional view showing a state where the second mounting member 60 is fixed to the wall surface Ws.

As shown in FIGS. 12 to 14, the air conditioner 100 includes a spacer member 90 for positioning the second mounting member 60 in the vertical direction. The spacer member 90 is a substantially rectangular plate-shaped member that extends in the right-left direction and of which the plate surface faces in the vertical direction. A material forming the spacer member 90 is, for example, foamed polystyrene or the like. The spacer member 90 includes a substantially rectangular plate-shaped spacer body portion 91 extending in the right-left direction, and a protruding portion 92 protruding downward from the spacer body portion 91.

A positioning concave portion 91*a* recessed forward (+X direction) is provided in the central portion of the rear-side (−X side) edge portion of the spacer body portion 91 in the right-left direction. Both sides of the positioning concave portion 91*a* open in the vertical direction. The positioning concave portion 91*a* extends in the right-left direction. The dimension of the positioning concave portion 91*a* in the right-left direction is substantially the same as the dimension of the positioning convex portion 63 of the second mounting member 60 in the right-left direction. A substantially rectangular concave portion 91*c* recessed downward is provided on the upper surface of the spacer body portion 91. A pair of concave portions 91*c* are provided to sandwich the positioning concave portion 91*a* in the right-left direction. The pair of concave portions 91*c* can respectively accommodate the pair of engaging portions 62 therein, for example, when the spacer member 90 is packed together with the second mounting member 60.

The spacer body portion 91 includes a placement portion 91*b*. The placement portions 91*b* are portions that sandwich the positioning concave portion 91*a* in the right-left direction in the rear-side (−X side) edge portion of the spacer body portion 91. The placement portion 91*b* is recessed below a portion of the spacer body portion 91 which is positioned in front of the placement portion 91*b*. The placement portions 91*b* extend in the right-left direction. The second mounting member 60 is placed on the placement portion 91*b* from above. The protruding portion 92 protrudes downward from the rear-side portion in the left-side (+Y side) end portion of the spacer body portion 91.

The operator or the like who installs the air conditioner 100 fixes the indoor unit 20 to the wall surface Ws and then disposes the spacer member 90 on the upper surface of the indoor unit 20 as shown in FIG. 12. The operator or the like places the spacer body portion 91 of the spacer member 90 on the rear-side (−X side) edge portion of the upper surface of the indoor unit 20 and brings the rear-side surface of the spacer body portion 91 into contact with the wall surface Ws. Thereby, the spacer member 90 can be positioned in the vertical direction and the front-rear direction with respect to the indoor unit 20. In addition, the operator or the like hooks the protruding portion 92 on the wall portion on the left side (+Y side) of the indoor unit housing 21 of the indoor unit 20 from the left. Thereby, the spacer member 90 can be positioned in the right-left direction with respect to the indoor unit 20.

The operator or the like places the second mounting member 60 on the placement portion 91*b* of the spacer member 90 from above. Thereby, the second mounting member 60 can be positioned in the vertical direction with respect to the spacer member 90. As shown in FIG. 13, at this time, the operator or the like fits the positioning convex portion 63 of the second mounting member 60 into the positioning concave portion 91*a*. Thereby, the second mounting member 60 can be positioned in the right-left direction with respect to the spacer member 90. Thus, the second mounting member 60 is placed on the spacer member 90 in a state where the spacer member 90 is positioned with respect to the indoor unit 20 as described above, and thus the second mounting member 60 can be positioned in the vertical direction and the right-left direction with respect to the indoor unit 20. In this state, the operator or the like fixes the second mounting member 60 to the wall surface Ws. The operator or the like fixes the second mounting member 60 to the wall surface Ws and then detach the spacer member 90 from the upper surface of the indoor unit 20.

According to the present embodiment, the discharge unit 30 including the discharge device 50 is provided outside the indoor unit 20 as a unit separate from the indoor unit 20, and the discharge unit 30 is disposed above the indoor unit 20. For this reason, the discharge unit 30 can be attached to the indoor unit 20 without changing the internal structure of the existing indoor unit 20. Thereby, the discharge unit 30 can be easily attached to any indoor unit 20 having any internal structure as long as the indoor unit 20 includes the suction port 21*e* that opens upward. Thus, according to the present embodiment, the discharge device 50 can be easily attached to the indoor unit 20.

Further, the discharge device 50 is disposed above the suction port 21*e* of the indoor unit 20, and at least a portion of the air AF suctioned into the suction port 21*e* passes through the discharge device 50. For this reason, the air AF can pass through the discharge device 50 by using the blower 23 of the indoor unit 20. Thereby, it is not necessary to provide the blower 23 in the discharge device 50. Thus, the dimension of the discharge device 50 in the vertical direction can be reduced. In addition, it is possible to reduce the number of parts of the discharge device 50 and reduce the manufacturing cost of the discharge device 50.

In addition, according to the present embodiment, the discharge device 50 is driven based on a signal received from the first control unit 24 of the indoor unit 20. For this reason, the discharge device 50 can be preferably driven in accordance with driving conditions of the blower 23. Thereby, the discharge device 50 can be efficiently driven. Further, for example, unlike a case where the discharge device 50 is driven by detecting a flow of the air AF generated by the blower 23, the discharge unit 30 does not need to be provided with a sensor for detecting the flow of the air AF. For this reason, an increase in the number of parts of the discharge unit 30 can be suppressed. In addition, it is also possible to suppress the occurrence of a problem such as the discharge device 50 not being driven due to a failure of the sensor, or the like.

Further, according to the present embodiment, the discharge unit 30 includes the signal wiring 81 that electrically connects the discharge device 50 and the first control unit 24. For this reason, compared to a case where a signal of the first control unit 24 is wirelessly transmitted to the discharge unit 30, it is not necessary to provide a transmission unit and a reception unit for wireless communication, and an increase in the number of parts of the discharge unit 30 can be suppressed.

In addition, the shape of the upper surface of the indoor unit 20 varies depending on the model of the indoor unit 20. For this reason, for example, in the case of a structure in which the discharge unit 30 is attached to be placed on the upper surface of the indoor unit 20, it may be difficult to attach the discharge unit 30 depending on the shape of the upper surface of the indoor unit 20. In addition, a vibration of a motor that rotates the blower 23 of the indoor unit 20 is directly transmitted to the discharge unit 30, and there is a concern that the discharge unit 30 will generate an abnormal sound and that parts inside the discharge unit 30 will resonate.

On the other hand, according to the present embodiment, the discharge unit 30 is disposed above the indoor unit 20 at a predetermined gap G therebetween. For this reason, the discharge unit 30 can be easily attached to the indoor unit 20 regardless of the shape of the upper surface of the indoor unit 20. In addition, since the discharge unit 30 does not come into direct contact with the indoor unit 20, it is possible to prevent the vibration of the motor that rotates the blower 23 from being transmitted to the discharge unit 30. Thereby, it is possible to prevent an abnormal sound from being generated from the discharge unit 30 and prevent parts inside the discharge unit 30 from resonating. Thus, it is possible to omit evaluation of a vibration and a transmitted sound between the indoor unit 20 and the discharge unit 30, and it is easy to attach the discharge unit 30 safely without concerning the quality.

Further, according to the present embodiment, the discharge unit 30 includes the hook portion 36 and the screwing portion 32*r* as attachment portions to be attached to the wall surface Ws. For this reason, the discharge unit 30 can be fixed to the wall surface Ws. Thereby, the discharge unit 30 can be easily disposed at a position spaced upward from the indoor unit 20. In addition, it is easier to stably fix the discharge unit 30 than in a case where the discharge unit 30 is fixed to the indoor unit 20. For this reason, compared to a case where the discharge unit 30 is fixed to the indoor unit 20, the discharge unit 30 can be preferably prevented from falling. Thereby, it is easy to omit evaluations of fixation and falling of the discharge unit 30, and it is easier to safely attach the discharge unit 30 without concerning the quality.

Further, according to the present embodiment, the air conditioner 100 includes the first mounting member 28 which is fixed to the wall surface Ws and to which the indoor unit 20 is attached, and the second mounting member 60 which his fixed to the wall surface Ws and to which the discharge unit 30 is attached via the hook portion 36 and the screwing portion 32*r* as attachment portions. The first mounting member 28 and the second mounting member 60 are separate members. For this reason, even for the indoor unit 20 that has already been attached to the wall surface Ws, the discharge unit 30 can be fixed and attached to the wall surface Ws by using the second mounting member 60. Thereby, it is easy to stably attach the discharge unit 30 to the already installed indoor unit 20 later.

Further, according to the present embodiment, the second mounting member 60 includes the plurality of engaging portions 62 provided at intervals in the right-left direction of the indoor unit 20. The attachment portion of the discharge unit 30 includes the plurality of hook portions 36 hooked on the plurality of engaging portions 62 respectively. For this reason, the discharge unit 30 can be easily attached to the second mounting member 60 by hooking the hook portions 36 on the engaging portions 62. Thereby, the discharge unit 30 can be easily fixed to the wall surface Ws. In addition, since the hook portion 36 is hooked on the engaging portion 62, it is possible to prevent the posture of the discharge unit 30 from being inclined downward. For this reason, it is possible to prevent the discharge unit 30 from coming into contact with the upper surface of the indoor unit 20. Thereby, it is possible to further prevent an abnormal sound from being generated from the discharge unit 30 and prevent the parts inside the discharge unit 30 from resonating.

Further, according to the present embodiment, the hook portion 36 includes the support portion 36*a* that protrudes forward from the indoor unit 20 more than the engaging portion 62 and supports the case 31 of the discharge unit 30 from below. For this reason, the case 31 of the discharge unit 30 can be preferably supported from below by the support portion 36*a*. Thus, it is possible to preferably prevent the attachment position of the discharge unit 30 from deviating downward.

Further, according to the present embodiment, the attachment portion of the discharge unit 30 includes the screwing portion 32*r* screwed to the second mounting member 60. For this reason, the discharge unit 30 can be more firmly fixed to the second mounting member 60. Thereby, the discharge unit 30 can be more stably fixed to the wall surface Ws. In the present embodiment, the through hole 32*j* and the screwing portion 32*r* are exposed forward in a state where the discharge device cover 34 and the discharge device 50 are detached from the base member 32. For this reason, in a state where the base member 32 is attached to the second mounting member 60 by the hook portion 36, it is easy to insert a tool such as a screwdriver into the case 31 from the front to screw the screwing portion 32*r*.

Further, in a case where the discharge unit 30 is disposed separately above the indoor unit 20 as in the present embodiment, a suction force received by air AF from the blower 23 is reduced as the discharge unit 30 is separated above the indoor unit 20, and the flow rate of the air AF passing through the discharge unit 30 is reduced. For this reason, the amount of air AF that passes through the discharge device 50 and is cleaned per unit time is reduced. That is, the ability of the discharge unit 30 to clean the air AF is lowered. Thus, it is preferable to make the gap G between the indoor unit 20 and the discharge unit 30 as small as possible within a range in which the discharge unit 30 and the indoor unit 20 do not come into contact with each other.

On the other hand, according to the present embodiment, the air conditioner 100 includes the spacer member 90 for positioning the second mounting member 60 in the vertical direction. The spacer member 90 has the placement portion 91*b* on which the second mounting member 60 is placed from above. The second mounting member 60 is positioned in the vertical direction by being placed on the placement portion 91*b* of the spacer member 90 disposed on the upper surface of the indoor unit 20. For this reason, the second mounting member 60 can be preferably positioned at a position separated from the upper surface of the indoor unit 20 by the dimension of the spacer member 90 in the vertical direction. Thereby, it is possible to adjust the gap G between the indoor unit 20 and the discharge unit 30 attached to the second mounting member 60 by adjusting the dimension of the spacer member 90 in the vertical direction. Thus, it is easy to adjust the gap G to a suitable size, and it is possible to suppress a decrease in the flow rate of the air AF passing through the discharge device 50 while sufficiently separating the discharge unit 30 from the indoor unit 20. For this reason, it is possible to suppress a decrease in the ability of the discharge unit 30 to clean the air AF.

Specifically, the dimension H of the gap G in the vertical direction between the indoor unit 20 and the discharge unit 30 is, for example, 5 mm or more and 50 mm or less. When the dimension H is 5 mm or more, the discharge unit 30 can be preferably prevented from coming into contact with the indoor unit 20 even when the attached discharge unit 30 is slightly inclined downward due to its own weight. In addition, when the dimension H is 50 mm or less, it is possible to suppress a large decrease in the ability of the discharge unit 30 to clean the air AF. When the dimension H is 50 mm or less, a decrease in the ability of the discharge unit 30 to clean the air AF is suppressed to less than 50% as compared with a case where the dimension H is 5 mm. By setting the dimension H to 5 mm, it is possible to preferably prevent the discharge unit 30 from coming into contact with the indoor unit 20 and preferably prevent the ability of the discharge unit 30 to clean the air AF from deteriorating.

Further, according to the present embodiment, the case 31 includes the control unit cover 33 positioned above the second control unit 40, and the discharge device cover 34 positioned above the discharge device 50. The discharge device cover 34 is detachably attached. The discharge device 50 is detachably accommodated in the case 31 with the discharge device cover 34 removed. For this reason, a user or the like can detach the discharge device 50 from the discharge unit 30 by removing the discharge device cover 34 when the discharge device 50 is cleaned, or the like. Thereby, compared to a case where it is necessary to remove both the control unit cover 33 and the discharge device cover 34 of the discharge unit 30, the user or the like can easily perform work such as cleaning the discharge device 50. In addition, the discharge device 50 can be detached with the control unit cover 33 attached. For this reason, when the user or the like detaches the discharge device 50, it is possible to prevent the user or the like from coming into contact with the second control unit 40.

Figure 15:
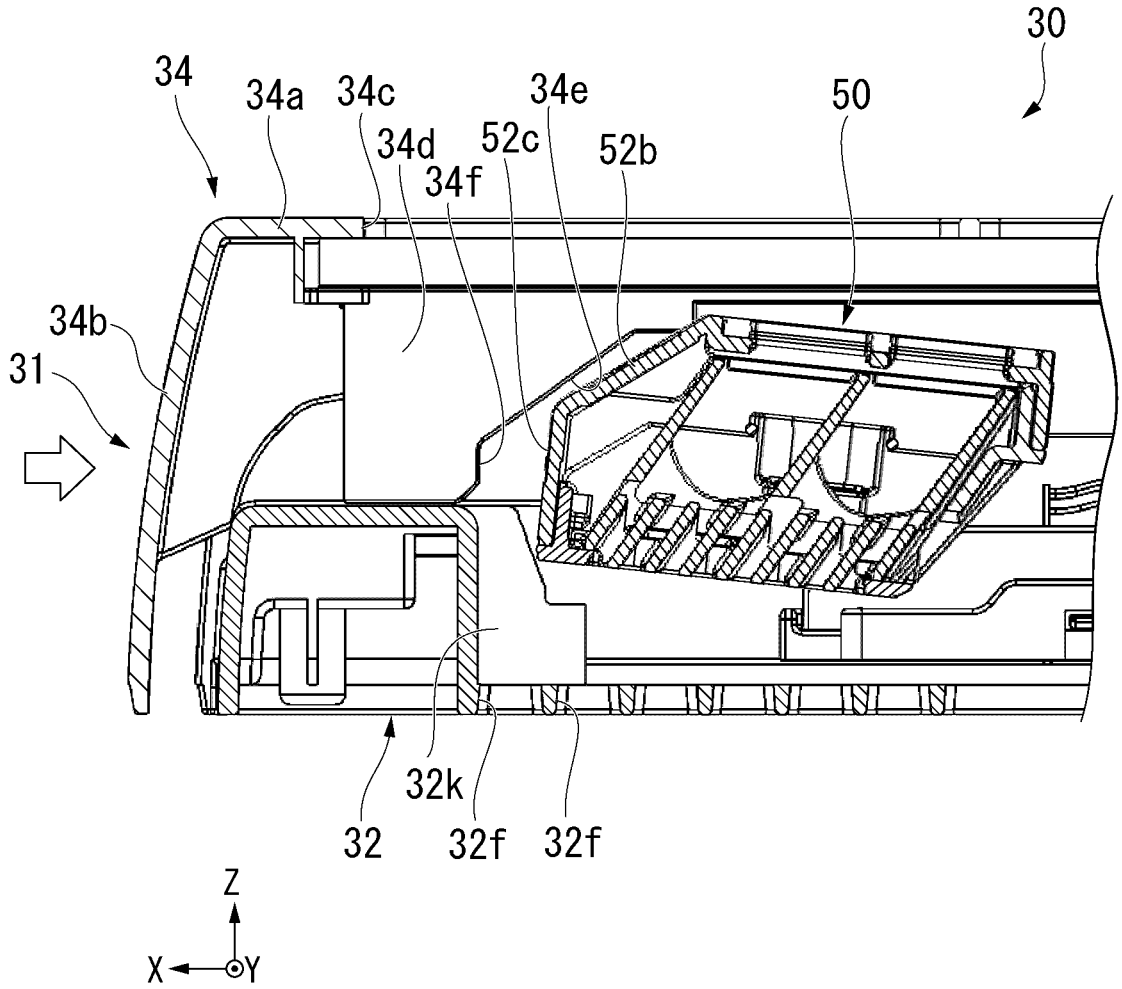
FIG. 15 is a diagram showing an example when a discharge device cover is attached in the embodiment.

Further, according to the present embodiment, the discharge device cover 34 includes the protruding portion 34*d* that presses the discharge device 50 from above and from the front (+X direction). For this reason, for example, when the discharge device cover 34 is inserted from the front to the rear (−X direction) with the discharge device 50 being inclined with respect to the base member 32 as shown in FIG. 15, a rearward force and a downward force can be applied to the discharge device 50 by the protruding portion 34*d*. Thereby, it is easy to correct the posture of the discharge device 50 with respect to the base member 32 to the correct posture by the protruding portion 34*d*. In the example of FIG. 15, a corner portion at which the inclined wall portion 52*b* and the front wall portion 52*c* are connected is pressed rearward and downward by the inclined surface 34*e* of the protruding portion 34*d*, thereby correcting the posture of the discharge device 50 to the correct posture.

For this reason, even when the discharge device 50 is disposed in a slightly inclined state when the discharge device 50 is disposed on the base member 32, the user or the like can correctly attach the discharge device 50 to the inside of the case 31 by attaching the discharge device cover 34. For this reason, it is possible to easily and preferably perform the work of attaching the discharge device 50 to the inside of the case 31. Thereby, it is possible to prevent the discharge device 50 from being electrically disconnected from the second control unit 40. Thus, it is possible to prevent an abnormal sound from being generated due to electric leakage, noise, and short-gap discharge caused by electrical disconnection between the discharge device 50 and the second control unit 40.

Further, according to the present embodiment, the discharge device 50 is an electric dust collector including the discharge portion 50*a* and the dust collecting portion 50*b*. For this reason, a user or the like can purify the indoor air AF by the discharge device 50 by attaching the discharge unit 30 to the existing indoor unit 20 later.

Further, according to the present embodiment, the discharge unit 30 includes the pre-filter 35 that is positioned above the discharge device 50. For this reason, the pre-filter 35 can catch relatively large dust such as fibers mixed in the air AF before passing through the discharge device 50. Thereby, it is possible to prevent the discharge device 50 from being clogged with dust.

Further, according to the present embodiment, in the right-left direction of the indoor unit 20, the center of the discharge unit 30 is disposed to be shifted to one side with respect to the center of the indoor unit 20 in the right-left direction, that is, the left side (+Y side) in the present embodiment. For this reason, for example, a portion of the discharge unit 30 through which the air AF cannot pass is disposed above a portion of the indoor unit 20 through which the air AF cannot pass, and thus it is possible to prevent the discharge unit 30 from blocking a portion of the suction port 21*e*. Thereby, it is possible to efficiently make the discharge unit 30 pass through the air AF while suppressing a decrease in the amount of the air AF suctioned into the indoor unit 20. Further, in a case where the indoor unit 20 and the discharge unit 30 are connected by the signal wiring 81 as in the present embodiment, it is possible to make it easy to electrically connect the indoor unit 20 and the discharge unit 30 at an end portion on the same side in the right-left direction. Thereby, it is possible to facilitate the work of connecting the indoor unit 20 and the discharge unit 30 via the signal wiring 81. In addition, since the signal wiring 81 can be easily shortened, it is possible to prevent the signal wiring 81 from becoming an obstacle. In addition, since it is not necessary to align the dimension of the discharge unit 30 in the right-left direction with the dimension of the indoor unit 20 in the right-left direction, the discharge unit 30 can be easily attached to a plurality of types of indoor units 20 having different dimensions in the right-left direction.

Further, according to the present embodiment, the dimension of the discharge unit 30 in the right-left direction is smaller than the dimension of the indoor unit 20 in the right-left direction. For this reason, the discharge unit 30 can be disposed to be shifted in the right-left direction with respect to the indoor unit 20 in a state where the discharge unit 30 does not protrude in the right-left direction with respect to the indoor unit 20. Thereby, it is possible to prevent the discharge unit 30 from interfering with an indoor wall or the like. Further, for example, by making the dimension of the discharge unit 30 in the right-left direction smaller than any dimension of the existing indoor unit 20 in the right-left direction, it is possible to prevent the discharge unit 30 from protruding more in the right-left direction than the indoor unit 20 even when the discharge unit 30 is attached to any type of existing indoor unit 20.

Further, according to the present embodiment, the left-side (+Y side) end portion of the discharge unit 30 is disposed at the same position in the right-left direction as the left-side end portion of the indoor unit 20. For this reason, the discharge unit 30 does not protrude in the right-left direction with respect to the indoor unit 20, and it is possible to preferably prevent the discharge unit 30 from interfering with the indoor wall or the like. Further, for example, as compared with a case where the left-side end portion of the discharge unit 30 is positioned on the right side (−Y side) of the left-side end portion of the indoor unit 20, a portion of the discharge unit 30 through which the air AF cannot pass can be easily disposed to be superimposed above a portion of the indoor unit 20 through which the air AF cannot pass.

Further, according to the present embodiment, the first control unit 24 of the indoor unit 20 is positioned on the left side (+Y side) of the heat exchanger 22 and the blower 23 inside the indoor unit housing 21. The second control unit 40 of the discharge unit 30 is positioned on the left side of the discharge device 50. That is, the control units of the indoor unit 20 and the discharge unit 30 are disposed on a side where the discharge unit 30 is shifted with respect to the indoor unit 20. For this reason, it is easy to dispose the second control unit 40 of the discharge unit 30 above the first control unit 24 of the indoor unit 20. In the present embodiment, at least a portion of the second control unit 40 is disposed to be superimposed above the first control unit 24. Air AF cannot pass through each control unit in the vertical direction. For this reason, by disposing at least a portion of the second control unit 40 to be superimposed above the first control unit 24, a portion of the discharge unit 30 through which the air AF cannot pass can be preferably disposed above a portion of the indoor unit 20 through which the air AF cannot pass. In addition, the first control unit 24 and the second control unit 40 can be disposed at positions close to each other in the right-left direction, and the first control unit 24 and the second control unit 40 can be easily connected to each other by the signal wiring 81.

In addition, according to the present embodiment, the left-side (+Y side) end portion of the case 31 is provided with the lead-out hole 32*p* through which the signal wiring 81 is led out. The left-side portion of the first control unit 24 is provided with the connection portion 24*a* to which the signal wiring 81 is connected. For this reason, it is possible to make it easier to connect the signal wiring 81 led out from the discharge unit 30 to the first control unit 24.

Further, according to the present embodiment, the discharge unit 30 includes the power supply wiring 82 connected to a power supply different from that of the indoor unit 20. For this reason, in a case where the discharge unit 30 is attached to the indoor unit 20, it is not necessary to supply a portion of power supplied to the indoor unit 20 to the discharge unit 30. Thereby, in a case where the discharge unit 30 is attached, it is not necessary to change a power supply system in the indoor unit 20, or the like. Thus, the discharge device 50 can be attached to the indoor unit 20 more easily.

Further, according to the present embodiment, the power supply wiring 82 is led out from the lead-out hole 32*p* through which the signal wiring 81 is led out. For this reason, in a case where the power supply wiring 82 is led out to the outside of the discharge unit 30, it is not necessary to provide a separate lead-out hole, and the number of holes provided in the case 31 of the discharge unit 30 can be reduced. In addition, it is easy to collectively manage wirings led out from the discharge unit 30.

Further, according to the present embodiment, the power supply wiring 82 is connected to the second control unit 40 from the left side (+Y side). For this reason, as compared to a case where the power supply wiring 82 is connected to the second control unit 40 from the rear side (−X side), the power supply wiring 82 is less likely to interfere with the wall surface Ws, and the work of connecting the power supply wiring 82 to the second control unit 40 can be easily performed.

Further, according to the present embodiment, a portion of the signal wiring 81 and a portion of the power supply wiring 82 pass between the indoor unit 20 and the wall surface Ws. For this reason, a portion of the signal wiring 81 and a portion of the power supply wiring 82 can be covered with the indoor unit 20 so as not to be seen from the front. Thereby, as compared with a case where the signal wiring 81 and the power supply wiring 82 are exposed along the side surface of the indoor unit 20, the appearance seen from a user or the like can be improved.

Further, according to the present embodiment, the hook portion 36 is disposed to fit within the dimensions of the case 31 in the vertical direction. For this reason, even when the hook portion 36 is provided, it is possible to suppress an increase in the size of the discharge unit 30. Thereby, it is easy to pack the discharge unit 30 before it is attached to the indoor unit 20. In addition, the engaging portion 62 on which the hook portion 36 is hooked is disposed to fit within the dimensions of the back plate portion 61 in the vertical direction. For this reason, the position in the vertical direction where the hook portion 36 is hooked can be easily set near the center of the back plate portion 61 in the vertical direction. Thereby, it is possible to suppress an increase in the size of the second mounting member 60 in the vertical direction. Thus, a dimension in the vertical direction required for attaching the discharge unit 30 to the wall surface Ws can be reduced. For this reason, even when a distance between the indoor unit 20 and the ceiling is relatively small, it is easy to dispose the discharge unit 30 above the indoor unit 20.

Although the embodiment of the present disclosure has been described above, the present disclosure is not limited to only the configurations of the above-described embodiment, and the following configurations and methods can also be adopted.

A discharge unit may be fixed to the upper surface of an indoor unit. The dimension of the discharge unit in the right-left direction is not particularly limited. The dimension of the discharge unit in the right-left direction may be larger than the dimension of the indoor unit in the right-left direction, or may be the same as the dimension of the indoor unit in the right-left direction. The center of the discharge unit in the right-left direction may be at the same position in the right-left direction as the center of the indoor unit in the right-left direction. The discharge device may be any device as long as it performs discharge. The discharge device may be an ozone generator.

The discharge device may be connected to the indoor unit in any way as long as it is driven based on a signal received from a first control unit of the indoor unit. The discharge device may wirelessly receive a signal from the first control unit of the indoor unit and be driven based on the received signal. In this case, the discharge unit includes a terminal to which a wireless adapter is connected. According to this configuration, it is not necessary to perform the work of connecting a signal wiring. For this reason, the discharge unit can be attached to the indoor unit more easily.

A mounting member to which an attachment portion of the discharge unit is attached, that is, the second mounting member 60 in the above-described embodiment, may be provided in the discharge unit. For example, the indoor unit and the discharge unit may be fixed to a wall surface by one mounting member, or may be fixed directly to the wall surface.

The configurations and methods described above in this specification can be appropriately combined as long as they do not contradict each other.

The invention claimed is:

1. An air conditioner comprising:

an indoor unit which is wall-mounted and which includes a heat exchanger, a blower, and a housing that accommodates the heat exchanger and the blower therein, and which is fixed to a wall surface;

a discharge unit which is disposed above the indoor unit outside the indoor unit; and a case, wherein the housing includes a suction port that opens upward, the discharge unit includes a discharge device disposed above the suction port, and a first control unit which is disposed in the case and that controls the discharge device, and the discharge unit is disposed above the indoor unit with a gap therebetween, the case includes a base member, a discharge device cover positioned above the discharge device and attached to the base member, and a control unit cover positioned over the first control unit and attached to the base member, the discharge device cover is configured to be attached to or detached from the base member and is separate from the control unit cover, the discharge device being accommodated on the base member and under the discharge device cover, the discharge device being configured to be attached to or detached from the base member with the discharge device cover removed from the base member, and at least a portion of air suctioned into the suction port passes through the discharge device.

2. The air conditioner according to claim 1, wherein the discharge unit includes a signal wiring that electrically connects the discharge device and a second control unit that controls the indoor unit.

3. The air conditioner according to claim 1, wherein the discharge unit includes an attachment portion attached to the wall surface.

4. The air conditioner according to claim 3, further comprising:

a first mounting member which is fixed to the wall surface and to which the indoor unit is attached; and a second mounting member which is fixed to the wall surface and to which the discharge unit is attached via the attachment portion, wherein the first mounting member and the second mounting member are separate members.

5. The air conditioner according to claim 4, wherein the second mounting member includes a plurality of engaging portions provided at intervals in a right-left direction of the indoor unit, and the attachment portion includes a plurality of hook portions that are hooked on the plurality of engaging portions, respectively.

6. The air conditioner according to claim 5, wherein a hook portion of the plurality of hook portions includes a support portion that protrudes forward from the indoor unit more than a corresponding engaging portion of the plurality of engaging portions and supports the case from below.

7. The air conditioner according to claim 4, wherein the attachment portion includes a screwing portion screwed to the second mounting member.

8. The air conditioner according to claim 4, further comprising:

a spacer member for positioning the second mounting member in a vertical direction, wherein the spacer member includes a placement portion on which the second mounting member is placed from above, and the second mounting member is positioned in the vertical direction by being placed on the placement portion of the spacer member disposed on an upper surface of the indoor unit.

9. The air conditioner according to claim 1, wherein the discharge device is an electric dust collector including a discharge portion and a dust collecting portion.

10. The air conditioner according to claim 1, wherein the discharge unit includes a pre-filter positioned above the discharge device.

11. A discharge unit and a case, wherein the discharge unit is disposed above an indoor unit which is wall-mounted with a gap therebetween outside the indoor unit fixed to a wall surface, the discharge unit includes a discharge device and a first control unit which is disposed in the case and that controls the discharge device, the discharge device is disposed above a suction port provided in the indoor unit, the case includes a base member, a discharge device cover positioned above the discharge device and attached to the base member, and a control unit cover positioned over the first control unit and attached to the base member, the discharge device cover is configured to be attached to or detached from the base member and is separate from the control unit cover, the discharge device being accommodated on the base member and under the discharge device cover, the discharge device being configured to be attached to or detached from the base member with the discharge device cover removed from the base member, and at least a portion of air suctioned into the suction port passes through the discharge device.

12. The discharge unit and the case according to claim 11, wherein the discharge unit includes a signal wiring that electrically connects the discharge device and a control unit of the indoor unit, the control unit being accommodated in the indoor unit.

13. The discharge unit and the case according to claim 11, wherein the discharge unit includes an attachment portion that is attached to the wall surface.

14. The discharge unit and the case according to claim 13, wherein the discharge unit includes a mounting member that is fixed to the wall surface and to which the attachment portion is attached.

15. The air conditioner according to claim 1, wherein the indoor unit includes a second control unit that controls the indoor unit, and the discharge device is driven based on a signal received from the second control unit.

16. The discharge unit and the case according to claim 11, wherein the discharge device is driven based on a signal received from a control unit of the indoor unit.

17. The air conditioner according to claim 1, further comprising a rear wall and a side wall of the case as part of the base member, a front wall opposite to the rear wall of the case as part of the discharge device cover, and wherein the discharge device is configured to slide to be attached to or detached from the base member with the discharge device cover removed from the base member.

18. The discharge unit and the case according to claim 11, further comprising a rear wall and a side wall of the case as part of the base member, a front wall opposite to the rear wall of the case as part of the discharge device cover, and wherein the discharge device is configured to slide to be attached to or detached from the base member with the discharge device cover removed from the base member.

* * * * *